US007113026B2

(12) United States Patent
Yamahira

(10) Patent No.: US 7,113,026 B2
(45) Date of Patent: Sep. 26, 2006

(54) VOLTAGE GENERATING CIRCUIT

(75) Inventor: Seiji Yamahira, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/147,257

(22) Filed: Jun. 8, 2005

(65) Prior Publication Data

US 2005/0231265 A1 Oct. 20, 2005

Related U.S. Application Data

(62) Division of application No. 10/731,640, filed on Dec. 10, 2003, now Pat. No. 6,914,474.

(30) Foreign Application Priority Data

Dec. 12, 2002 (JP) ..... 2002-361272

(51) Int. Cl.
*G05F 1/10* (2006.01)

(52) U.S. Cl. ..... 327/540

(58) Field of Classification Search ..... 327/534–537, 327/540, 541

See application file for complete search history.

(56) References Cited

U.S. PATENT DOCUMENTS 4,769,784 A 9/1988 Doluca et al.
5,642,072 A 6/1997 Miyamoto et al.
5,754,418 A 5/1998 Park et al.
5,859,797 A 1/1999 Maccarrone et al.
6,208,123 B1 3/2001 Sudo
6,282,108 B1 8/2001 Yang
6,590,442 B1 7/2003 Byeon et al.
2004/0251955 A1 12/2004 Neidorff

FOREIGN PATENT DOCUMENTS

JP 2001-52489 A 2/2001

*Primary Examiner*—Jeffrey Zweizig
(74) *Attorney, Agent, or Firm*—McDermott Will & Emery LLP

(57) ABSTRACT

To provide a voltage generating circuit for generating a boosted voltage on the basis of a power source voltage or any voltage.

A voltage generating circuit having a boosting circuit 1 for generating a voltage higher than a power source voltage, and a reference voltage generating circuit 2 for generating a reference voltage Vref is equipped with a voltage variation detecting circuit 4 having a first input connected to the output of the boosting circuit 1, a second input having a power source Vdd and a third input connected to the ground Vss, a control voltage Vfd being generated at a first output by making reference current equivalent to current occurring due to the potential difference between the first input and the second input flow into the third input, a differential amplifier circuit 61 for comparing the control voltage Vfd and the reference voltage Vref, and a clamp circuit 62 for extracting current from the output of the boosting circuit 1 in accordance with the output of the differential amplifier circuit 61, thereby controlling the output voltage of the boosting circuit 1.

35 Claims, 24 Drawing Sheets

(CONT.)

(FIG. 30 CONTINUED)
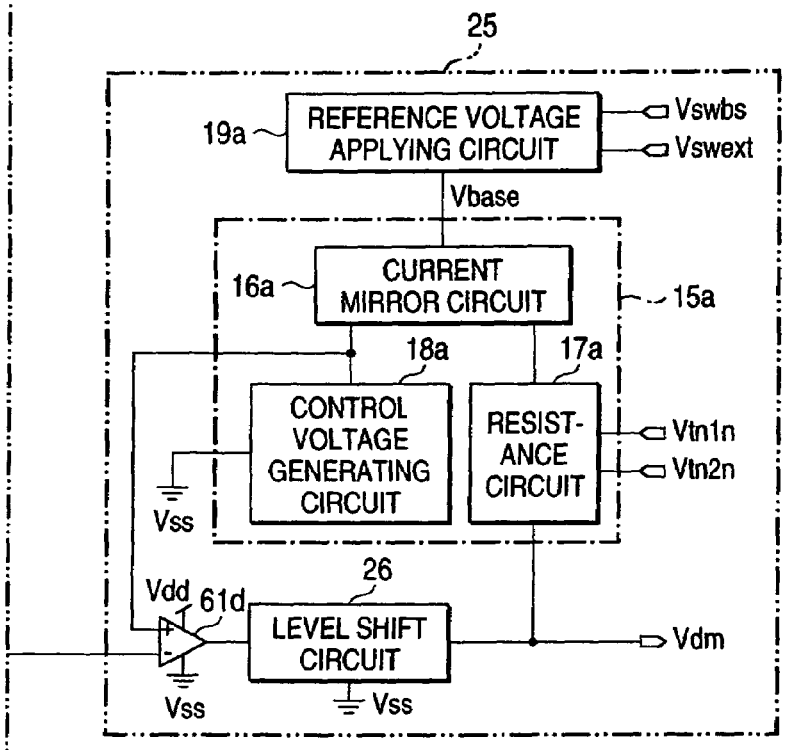

VOLTAGE GENERATING CIRCUIT

RELATED APPLICATION

This application is a Divisional of U.S. patent application Ser. No. 10/731,640, filed Dec. 10, 2003, now U.S. Pat. No. 6,914,474, which claims priority of Japanese Patent Application No. 2002-361272, filed Dec. 12, 2002, and the contents of which are hereby incorporated by reference.

BACKGROUND OF THE INVENTION

1. Field of the Invention

The present invention relates to a voltage generating circuit, and particularly to a voltage generating circuit for clamping or regulating the output voltage of a boosting power source circuit or negatively boosting power source circuit.

2. Description of the Related Art

Flash memories serving as non-volatile semiconductor storage devices have been recently required to perform data reading and data rewriting by using a single power source source, and thus a voltage generating circuit for generating a boosted voltage or negatively boosted voltage is needed on-chip. Furthermore, the flash memories are required to be estimated, and thus a mechanism for applying the voltage corresponding to the boosted voltage or negatively boosted voltage from the external.

A conventional voltage generating circuit will be described hereunder with reference to the drawings.

FIG. 31 is a block diagram showing the construction of the conventional voltage generating circuit. In the Fig., 900 represents a boosting circuit for boosting a power source voltage Vdd and generating a boosted voltage, 901 represents the output of the boosting circuit 900, 902 represents a reference voltage generating circuit for generating a reference voltage Vref from the power source voltage Vdd, 903 represents a limiter circuit for setting the output voltage of the boosting circuit 900 to a desired voltage, 904 represents a resistor R1, 905 represents a resistor R2, 906 represents a voltage dividing circuit comprising a resistor 904 and a resistor 905, 907 represents the output of the voltage dividing circuit 906, 908 represents a differential amplifier circuit that is supplied with the boosted voltage from the output 901 and compares the voltage of the output 907 and the reference voltage Vref to carry out differential amplification, 909 represents the output of the differential amplifier circuit 908, 910 represents a P-type MOS transistor for extracting the voltage of the output 901 to the power source Vdd in accordance with the voltage of the output 909, 911 represents a regulator circuit for level-shifting the voltage of the output 901 to a desired voltage, 912 represents a resistor R3, 913 represents a resistor R4, 914 represents a voltage dividing circuit comprising a resistor 912 and a resistor 913, 915 represents the output of the voltage dividing circuit 914, 916 represents a differential amplifier circuit that is supplied with the boosted voltage from the output 901 and compares the voltage of the output 915 and the reference voltage Vref to carry out differential amplification, 917 represents the output of the differential amplifier circuit 916, 918 represents a P-type MOS transistor for setting the output Vp1 of the regulator circuit 911 to a desired voltage in accordance with the voltage of the output 917, and 919 represents a pad for applying a voltage from the external.

The circuit operation of the voltage generating circuit thus constructed will be described with reference to FIGS. 31 and 32.

A booted voltage VPh generated from the power source voltage is supplied to the limiter circuit 903 by the boosting circuit 900. A voltage of ($\gamma\times$Vph) is applied to the output of the voltage dividing circuit 906 on the basis of the resistance ratio $\gamma$ (=R2/(R1+R2) of the resistor 904 and the resistor 905. The reference voltage Vref generated from the power source voltage is compared with ($\gamma\times$Vph) in the differential amplifier circuit 908 to control the gate voltage of the P-type MOS transistor 910 and adjust the drain current to be extracted from the output 901 to the power source Vdd, thereby keeping the boosted voltage Vph constant. With the foregoing operation, the boosted voltage Vph becomes a voltage satisfying Vph=Vref(1/$\gamma$) because Vref=($\gamma\times$Vph). That is, the boosted voltage Vph is not dependent on the power source voltage and keeps a constant voltage value for Vph>Vref$\times$(1/$\gamma$).

The boosted voltage Vph is supplied to the regulator circuit 911. When a voltage Vpl achieved by level-shifting Vph is applied to the voltage dividing circuit 914, a voltage of ($\xi\times$Vpl) is applied to the output of the voltage dividing circuit 914 on the basis of the resistance ratio $\xi$ (=R4/(R3+R4) of the resistor 912 and the resistor 913. The reference voltage Vref generated from the power source voltage is compared with ($\xi\times$Vpl) in the differential amplifier circuit 916 to control the gate voltage of the P-type MOS transistor 918 and adjust the drain current to be supplied from the output 901 to the output of the regulator circuit 911, thereby keeping Vpl constant. With the above operation, the output voltage Vpl of the regulator circuit 911 becomes a voltage satisfying Vpl=Vref$\times$(1/$\xi$) because Vref=($\xi\times$Vpl), and it is not dependent on the power source voltage and keeps a constant voltage value for Vpl>Vref$\times$(1/$\xi$).

When the characteristic of a flash memory cell is estimated, the voltage Vppex corresponding to the boosted voltage is applied from the external through the pad 919.

The above conventional technique is directed to the description on the voltage generating circuit for boosting the power source voltage and generating a boosted voltage higher than the power source voltage. The foregoing is applied to a conventional voltage generating circuit for generating a lower voltage than the ground voltage. That is, the construction that the boosting circuit 900 is replaced by a negatively boosting circuit, the ground connected to the voltage dividing circuits 906 and 914 is replaced by a reference voltage, the reference voltage input to the differential amplifier circuits 908 and 916 is replaced by the ground and the P-type MOS transistors 910 and 918 are replaced by N-type MOS transistors is a voltage generating circuit for generating, from a negatively boosted voltage, a constant negative voltage which is not dependent on the power source voltage. The negative voltage generating circuit as described above is also equipped with abnegate pad for applying a negative voltage from the external.

As one of the voltage generating circuits of the above conventional technique is known a voltage generating circuit having a mechanism in which the differential amplifier circuit 918 is driven with a power source voltage Vdd to reduce the power consumption of the boosted voltage to generate a constant voltage (Referring to JP-A-2001-52489)

However, the limiter circuit 903 and the regulator circuit 911 of the conventional voltage generating circuit can output only a fixed voltage with respect to the power source voltage as shown in FIG. 32. This is also applied to the negative voltage generating circuit.

The following problems occur when the conventional voltage generating circuit as described above is applied to a memory circuit (for example, a flash memory cell shown in FIG. 33).

First, the construction of the flash memory cell is shown in FIG. 33. In FIG. 33, 920 represents a voltage generating circuit, 921 represents a row decoder, 922 represents a column driver, 923 represents a column decoder, 924 represents a power switch circuit, 925 represents a flash memory cell array, 926 represents a P-type flash memory cell, 927 represents a P-type selection transistor and 928 represents an N-type MOS transistor.

In the flash memory cell as described above, a flash memory cell as a reading target is determined by the row decoder and the column decoder in the data reading operation. At this time, the power source voltage Vdd is applied to Vwell, Vsl, Vcg, however, the ground voltage is applied to Vsg of the P-type selection transistor. Therefore, there is a problem that the cell current is varied due to variation of the power source voltage Vdd and the dependence degree of the reading speed on the power source voltage is increased.

Furthermore, at the data writing time, the power source voltage Vdd is applied to Vwell, and a negative boosted voltage which is constant irrespective of the power source voltage Vdd is applied to Vbl and Vsg while a positive boosted voltage which is constant irrespective of the power source voltage Vdd is applied to Vcg. Therefore, Vwell−Vbl and Vwell−Vcg that determine the data writing speed are varied due to variation of the power source voltage Vdd, and thus there is a problem that the data writing speed is greatly varied.

The variation of the device characteristic due to the voltage variation, that is, the variation of the circuit characteristic can be suppressed by keeping the drain current of the P-type MOS transistor and the N-type MOS transistor constant irrespective of the power source voltage Vdd. However, there is a problem that a boosted voltage or negatively boosted voltage cannot be supplied in conformity with the characteristic of a supply load.

When the memory cell is estimated, it is required to apply the voltage corresponding to the boosted voltage to the pad or apply the negative voltage corresponding to the negatively boosted voltage to the negative pad, and surge breaking may occur under the high voltage application.

SUMMARY OF THE INVENTION

The present invention has been implemented in view of the foregoing description, and has an object to provide a voltage generating circuit for suppressing variation of a device characteristic and a circuit characteristic due to variation of a power source voltage, and supplying a boosted voltage or negatively boosted voltage dependent on any reference voltage in accordance with a circuit to thereby enhance the circuit characteristic.

In order to attain the above object, according to claim 1, a voltage generating circuit having a boosting circuit for generating a higher voltage than a power source voltage, and a reference voltage generating circuit for generating a reference voltage, a desired voltage being generated on the basis of the reference voltage is characterized by comprising: a voltage variation detecting circuit having a first input connected to the output of the boosting circuit, a second input connected to the power source, and a third input connected to the ground, reference current equivalent to current occurring due to the potential difference between the first input and the second input being made to flow into the third input to thereby generate a control voltage at a first output; a differential amplifier circuit for comparing the control voltage and the reference voltage; and a clamp circuit for extracting current from the output of the boosting circuit in accordance with the output of the differential amplifier circuit to control the output voltage of the boosting circuit.

According to claim 2, a voltage generating circuit having a boosting circuit for generating a higher voltage than a power source voltage, and a reference voltage generating circuit for generating a reference voltage, a desired voltage being generated on the basis of the reference voltage is characterized by comprising: a reference voltage switching circuit for carrying out a switching operation between the power source voltage and the ground voltage in accordance with a reference voltage switching signal; a voltage variation detecting circuit having a first input connected to the output of the boosting circuit, a second input connected to the output of the reference voltage switching circuit, and a third input connected to the ground, reference current equivalent to current occurring due to the potential difference between the first input and the second input being made to flow into the third input to thereby generate a control voltage at a first output; a differential amplifier circuit for comparing the control voltage and the reference voltage; and a clamp circuit for extracting current from the output of the boosting circuit in accordance with the output of the differential amplifier circuit to control the output voltage of the boosting circuit.

According to claim 3, a voltage generating circuit having a boosting circuit for generating a higher voltage than a power source voltage, and a reference voltage generating circuit for generating a reference voltage, a desired voltage being generated on the basis of the reference voltage is characterized by comprising: an external voltage applying circuit for carrying out a switching operation between an external applied voltage and the power source voltage and outputting the switched one; a voltage variation detecting circuit having a first input connected to the output of the boosting circuit, a second input connected to the output of the reference voltage switching circuit, and a third input connected to the ground, reference current equivalent to current occurring due to the potential difference between the first input and the second input being made to flow into the third input to thereby generate a control voltage at a first output; a differential amplifier circuit for comparing the control voltage and the reference voltage; and a clamp circuit for extracting current from the output of the boosting circuit in accordance with the output of the differential amplifier circuit to control the output voltage of the boosting circuit.

According to claim 4, a voltage generating circuit having a boosting circuit for generating a higher voltage than a power source voltage, and a reference voltage generating circuit for generating a reference voltage, a desired voltage being generated on the basis of the reference voltage is characterized by comprising: a voltage variation detecting circuit having a first input connected to the output of the boosting circuit, a second input connected to the power source, and a third input connected to the ground, reference current equivalent to current occurring due to the potential difference between the first input and the second input being made to flow into the third input to thereby generate a control voltage at a first output; first switching means for receiving a set voltage switching signal, carrying out a switching operation between the first input and the ground voltage and outputting the switched one; second switching means connected between two terminals of the first input and the second input and switching the potential difference between the first input and the second input in accordance with the output voltage of the first switching means; a differential amplifier circuit for comparing the control voltage and the reference voltage; and a clamp circuit for extracting current from the output of the boosting circuit in accordance with the output of the differential amplifier circuit to control the output voltage of the boosting circuit.

According to claim 5, a voltage generating circuit having a boosting circuit for generating a higher voltage than a power source voltage, and a reference voltage generating circuit for generating a reference voltage, a desired voltage being generated on the basis of the reference voltage is characterized by comprising: a voltage variation detecting circuit having a first input connected to the output of the boosting circuit, a second input connected to the power source, and a third input connected to the ground, reference current being generated by a voltage applied to a fourth input so as to keep a constant current ratio to current occurring due to the potential difference between the first input and the second input, and being made to flow into the third input to thereby generate a control voltage at a first output; first switching means for receiving a set voltage switching signal, carrying out a switching operation between the first input and the ground voltage and outputting the switched one; second switching means connected between two terminals of the first input and the second input and switching the potential difference between the first input and the second input in accordance with the output voltage of the first switching means; third switching means connected to the output of the first switching means, switching any voltage between the first input and the second input or the ground voltage in accordance with the set voltage switching signal and applying the switching result to the fourth input; a differential amplifier circuit for comparing the control voltage and the reference voltage; and a clamp circuit for extracting current from the output of the boosting circuit in accordance with the output of the differential amplifier circuit to control the output voltage of the boosting circuit.

According to claim 6, the voltage generating circuit is characterized in that the clamp circuit has a first conduction type transistor having a source connected to the output of the boosting circuit, a gate connected to the output of the differential amplifier circuit and a drain connected to the power source or the ground, and the differential amplifier circuit is supplied with the output voltage of the boosting circuit, compares the control voltage and the reference voltage and carries out differential amplification with the output voltage of the boosting circuit.

According to claim 7, the voltage generating circuit is characterized in that the clamp circuit comprises a first conduction type first transistor having a source connected to the output of the boosting circuit, and a gate and a drain that are connected to a first terminal, a first conduction type second transistor having a source connected to the output of the boosting circuit, a gate connected to the first terminal and a drain connected to the power source or the ground, and a second conduction type transistor connected between the first terminal and the ground and having a gate connected to the output of the differential amplifier circuit, and said differential amplifier circuit is supplied with the output voltage of the boosting circuit, compares the control voltage and the reference voltage and carries out differential amplification with the power source voltage.

According to claim 8, a voltage generating circuit having a boosting circuit for generating a voltage higher than a power source voltage and a reference voltage generating circuit for generating a reference voltage, a desired voltage being generated on the basis of the reference voltage is characterized by comprising: a level shift circuit for receiving an output voltage of the boosting circuit to level-shift the voltage and outputting the voltage thus level-shifted; a voltage variation detecting circuit having a first input connected to the output of the level shift circuit, a second input connected to the power source and a third input connected to the ground, reference current equivalent to current occurring due to the potential difference between the first input and the second input being made to flow into the third input to generate a control voltage at a first output; and a differential amplifier circuit for comparing the control voltage and the reference voltage to control the level shift circuit, and outputting a desired voltage as the output of the level shift circuit.

According to claim 8, the voltage generating circuit is characterized by further comprising: first switching means for receiving a set voltage switching signal, carrying out a switching operation between the first input and the ground voltage and outputting the switched one; and second switching means connected between the first input and the second input for switching the potential difference between the first input and the second input in accordance with the output voltage of the first switching means.

According to claim 10, the voltage generating circuit is characterized by further comprising: a voltage variation detecting circuit having a first input connected to the output of the level shift circuit, a second input connected to the power source, a third input connected to the ground and a fourth input, reference current being generated by a voltage applied to the fourth input so as to keep a constant current ratio to current occurring due to the potential difference between the first input and the second input, and the reference current being made to flow into the third input to generate a control voltage at a first output; first switching means for receiving a set voltage switching signal, carrying out a switching operation between the first input and the ground voltage and outputting the switched one; second switching means connected between the first input and the second input for switching the potential difference between the first input and the second input in accordance with the output voltage of the first switching means; and third switching means connected to the output of the first switching means for switching to any voltage between the first input and the second input or the ground voltage and applying the switched voltage to the fourth input.

According to claim 11, the voltage generating circuit is characterized in that the level shift has a first conduction type transistor having a source connected to the output of the boosting circuit, a gate connected to the output of the differential amplifier circuit and a drain connected to the output of the level shift circuit, and the differential amplifier circuit is supplied with an output voltage of the boosting circuit, comparing the control voltage and the reference voltage and carrying out differential amplification on the basis of the output voltage of the boosting circuit.

According to claim 12, the voltage generating circuit is characterized in that the level shift circuit comprises a first conduction type first transistor having a source connected to the output of the boosting circuit and a gate and a drain that are connected to a first terminal; and a first conduction type second transistor having a source connected to the output of the boosting circuit, a gate connected to the first terminal and a drain connected to the output of the level shift circuit; and a second conduction type transistor connected between the first terminal and having a gate connected to the output of the differential amplifier circuit, and the differential amplifier circuit is supplied with the power source voltage, comparing the control voltage and the reference voltage and carrying out differential the differential amplification by the power source voltage.

According to claim 13, the voltage generating circuit is characterized by further comprising a reference voltage switching circuit for carrying out a switching operation between the power source voltage and the ground voltage in accordance with a reference voltage switching signal, wherein the second input is connected to the output of the reference voltage switching circuit.

According to claim 1, the voltage generating circuit is characterized by further comprising a reference voltage generating circuit for generating a reference voltage on the basis of the power source voltage, and a reference voltage switching circuit for carrying out a switching operation between the power source voltage or the ground voltage and the reference voltage in accordance with a reference voltage switching signal, wherein the second input is connected to the output of the reference voltage switching circuit.

According to claim 15, the voltage generating circuit is characterized by further comprising a reference voltage generating circuit for generating a reference voltage from the power source voltage, and a reference voltage switching circuit for selecting any one of the power source voltage, the ground voltage and the reference voltage in accordance with a reference voltage switching signal, wherein the second input is connected to the output of the reference voltage switching circuit.

According to claim 16, the voltage generating circuit is characterized by further comprising an external voltage applying circuit for carrying out a switching operation between an external voltage and the power source voltage in accordance with an external voltage applying signal and outputting the switched one, wherein the second input is connected to the output of the external voltage applying circuit.

According to claim 17, the voltage generating circuit is characterized by further comprising an external voltage applying circuit for carrying out a switching operation between an external voltage and the ground voltage in accordance with an external voltage applying signal and outputting the switched one, wherein the second input is connected to the output of the external voltage applying circuit.

According to claim 18, the voltage generating circuit is characterized by further comprising a reference voltage generating circuit for generating a reference voltage from the power source voltage, and an external voltage applying circuit for carrying out a switching operation between an external applied voltage and the reference voltage in accordance with an external voltage applying signal and outputting the switched one, wherein the second input is connected to the output of the external voltage applying circuit.

According to claim 19, the voltage generating circuit is characterized by further comprising an external voltage applying circuit for receiving an external applied voltage and the output voltage of the reference voltage switching circuit, and switching and outputting the output voltage in accordance with an external voltage applying signal, wherein the second input is connected to the output of the external voltage applying circuit.

According to claim 20, a voltage generating circuit having a negatively boosting circuit for generating a voltage lower than the ground voltage by using a power source voltage, and a reference voltage generating circuit for generating a reference voltage, a desired voltage being generated on the basis of the reference voltage is characterized by comprising: a voltage variation detecting circuit having a first input connected to the power source, a second input connected to the output of the negatively boosting circuit, and a third input connected to the ground, reference current equivalent to current occurring due to the potential difference between the first input and the second input being made to flow into the third input to generate a control voltage at a first output; a differential amplifier circuit for comparing the control voltage and the reference voltage; and a clamp circuit for extracting current from the output of the negatively boosting circuit in accordance with the output of the differential amplifier circuit to control the output voltage of the negatively boosting circuit.

According to claim 21, the voltage generating circuit is characterized in that the clamp circuit is equipped with a second conduction type transistor having a source and a substrate that are connected to the output of the negatively boosting circuit, a gate connected to the output of the differential amplifier circuit and a drain connected to the power source or the ground, and the differential amplifier circuit is supplied with the power source voltage and the output voltage of the negatively boosting circuit, compares the control voltage and the reference voltage with each other and carries out differential amplification on the basis of the power source voltage and the output voltage of the negatively boosting circuit.

According to claim 22, the voltage generating circuit is characterized in that the clamp circuit comprises: a second conduction type first transistor having a source and a substrate that are connected to the output of the negatively boosting circuit, and a gate and a drain that are connected to a first terminal; a second conduction type second transistor having a source and a substrate that are connected to the output of the negatively boosting circuit; and a first conduction type transistor connected between the power source and the first terminal and having a gate connected to the output of the differential amplifier circuit, and said differential amplifier circuit is supplied with the power source voltage and the ground voltage, compares the control voltage and the reference voltage with each other and carries out differential amplification on the basis of the power source voltage and the ground voltage.

According to claim 23, a voltage generating circuit having a negatively boosting circuit for generating a voltage lower than the ground voltage by using a power source voltage, and a reference voltage generating circuit for generating a reference voltage, a desired voltage being generated on the basis of the reference voltage, is characterized by comprising: a level shift circuit for receiving an output voltage of the negatively boosting circuit, and outputting a level-shifted voltage; a voltage variation detecting circuit having a first input connected to the power source, a second input connected to the output of the negatively boosting circuit, and a third input connected to the ground, reference current equivalent to current occurring due to the potential difference between the first input and the second input being made to flow into the third input to generate a control voltage at a first output; and a differential amplifier circuit for comparing the control voltage and the reference voltage to control the level shift circuit, and outputting a desired negative voltage at the output of the level shift circuit.

According to claim 24, a voltage generating circuit having a reference voltage generating circuit for generating a reference voltage and a voltage generating circuit for generating a desired voltage on the basis of the reference voltage, is characterized by comprising: a level shift circuit for receiving a ground voltage and outputting a level-shifted voltage; a voltage variation detecting circuit having a first input connected to the power source, a second input connected to the output of the negatively boosting circuit, and a third input connected to the ground, reference current equivalent to current occurring due to the potential difference between the first input and the second input being made to flow into the third input to generate a control voltage at a first output; and a differential amplifier circuit having means for comparing the control voltage and the reference voltage to control the level shift circuit so that a voltage dropped from a desired power source voltage is output from the output of the level shift circuit is output.

According to claim 25, the voltage generating circuit is characterized in that the level shift circuit has a second conduction type transistor having a source and a substrate that are connected to the output of the negatively boosting circuit, a gate connected to the output of the differential amplifier circuit and a drain connected to the output of the level shift circuit, and the differential amplifier circuit is supplied with the power source voltage and the output voltage of the negatively boosting circuit, compares the control voltage and the reference voltage and carries out differential amplification on the basis of the power source voltage and the output voltage of the negatively boosting circuit.

According to claim 26, the voltage generating circuit is characterized in that the level shift circuit has a second conduction type first transistor having a source and a substrate that are connected to the output of the negatively boosting circuit, and a gate and a drain that are connected to a first terminal, a second conduction type second transistor having a source and a substrate that are connected to the output of the negatively boosting circuit, a gate connected to the first terminal and a drain connected to the output of the level shift circuit, and a first conduction type transistor that is connected between the power source and the first terminal and has a gate connected to the output of the differential amplifier circuit, and the differential amplifier circuit is supplied with the power source voltage and the ground voltage, compares the control voltage and reference voltage and carries out differential amplification on the basis of the power source voltage and the ground voltage.

According to claim 27, the voltage generating circuit is characterized by further comprising: first switching means for receiving a set voltage switching signal and carrying to a switching operation between the power source voltage and the voltage of the second input and outputting the switched one; and second switching means connected between two terminals between the first input and the second input, and switching the potential difference between the first input and the second input in accordance with the output of the first switching means.

According to claim 28, the voltage generating circuit is characterized by further comprising a reference voltage switching circuit for any two voltages or three voltages of the power source voltage, the reference voltage and any reference voltage generated by the power source voltage on the basis of a reference voltage switching signal, wherein the first input is connected to the output of the reference voltage switching circuit.

According to claim 29, the voltage generating circuit is characterized by further comprising an external voltage applying circuit having means for carrying out a switching operation between an external applied voltage and the power source voltage, the reference voltage or any reference voltage generated by the power source voltage, wherein the first input is connected to the output of the external voltage applying circuit.

According to claim 30, the voltage generating circuit is characterized by further comprising an external voltage applying circuit for receiving an external applied voltage and the output voltage of the reference voltage switching circuit, carrying out a switching operation between the external applied voltage and the output voltage of the reference voltage switching circuit in accordance with an external voltage applying signal and outputting the switched one, wherein the first input is connected to the output of the external voltage applying circuit.

According to claim 31, the voltage generating circuit is characterized in that a voltage having the same voltage level as the reference voltage can be applied by a voltage follower circuit.

According to claim 32, the voltage generating circuit is characterized in that the voltage variation detecting circuit comprises: a current mirror circuit having a first intermediate node connected between the first input and the second input, and the first output connected between the first input and the third input, reference current equivalent to current occurring due to the potential difference between the first input and the second input being made to flow from the first input to the first output by detecting the voltage at the first intermediate node; resistance means connected between the first intermediate node and the second input; and a control voltage generating circuit that is connected between the first output and the third input, and generates the control voltage at the first output by making the reference current flow therethrough.

According to claim 33, the voltage generating circuit is characterized in that the voltage variation detecting circuit comprises: a current mirror circuit having a first intermediate node connected between the first input and the second input, and the first output connected between the first input and the third input, reference current that is kept to have a fixed current ratio to current occurring due to the potential difference between the first input and the second input being made to flow from the first input to the first output by the voltage applied to the fourth input; resistance means connected between the first intermediate node and the second input; and a control voltage generating circuit that is connected between the first output and the third input and generates the control voltage at the first output by making the reference current flow therethrough.

According to claim 34, the voltage generating circuit is characterized in that the resistance means has plural resistors that are connected to one another in series between the first intermediate node and the second input.

According to claim 35, the voltage generating circuit is characterized in that the resistance means has plural first conduction type tenth transistors that are connected to one another in series between the first intermediate node and the second input so that a gate and a drain are connected to each other and a substrate and a source are connected to each other.

According to claim 36, the voltage generating circuit is characterized in that the control voltage generating circuit has plural resistors that are connected to one another in series between the first output and the third input.

According to claim 37, the voltage generating circuit is characterized in that the control voltage generating circuit has one or more first conduction type tenth transistors that are connected to one another in series between the first output and the third input so that a gate and a drain are connected to each other and a source and a substrate are connected to each other.

According to claim 38, the voltage generating circuit is characterized in that the current mirror circuit comprises: a first conduction type eleventh transistor having a source connected to the first input, and a gate and a drain connected to the first intermediate node; and a first conduction type twelfth transistor having a source connected to the first input, a gate connected to the first intermediate node and a drain connected to the first output.

According to claim 39, the voltage generating circuit is characterized in that the current mirror comprises: plural resistors connected to one another in series between the first input and the first intermediate node; and a first conduction type thirteenth transistor having a source connected to the first input, a gate connected to the first intermediate node and a drain connected to the first output.

According to claim 40, the voltage generating circuit is characterized in that the current mirror circuit comprises: a first conduction type eleventh transistor having a source connected to the first input, and a gate and a drain that are connected to the first intermediate node; a first conduction type twelfth transistor having a source connected to the first input, a gate connected to the first intermediate node and a drain connected to the second intermediate node; and a first conduction type thirteenth transistor having a source connected to the second intermediate node, a gate connected to any terminal of the resistance means, and a drain connected to the first output.

According to claim 41, the voltage generating circuit is characterized in that the current mirror circuit comprises: plural resistors that are connected to one another in series between the first input and the first intermediate node; a first conduction type twelfth transistor having a source connected to the first input, a gate connected to the intermediate node and a drain connected to the second intermediate node; and a first conduction type thirteenth transistor having a source connected to the second intermediate node, a gate connected to any terminal of the resistance means and a drain connected to the first output.

According to claim 42, the voltage generating circuit is characterized in that the current mirror circuit comprises: a first conduction type eleventh transistor having a source connected to the first input, and a gate and a drain that are connected to the first intermediate node; a first conduction type twelfth transistor having a source connected to the first input, a gate connected to the first intermediate node and a drain connected to the second intermediate node; an a first conduction type thirteenth transistor having a source connected to the second intermediate node, a gate connected to the fourth input and a drain connected to the first output.

According to claim 43, the voltage generating circuit is characterized in that the current mirror circuit comprises: plural resistors connected to one another in series between the first input and the first intermediate node; a first conduction type twelfth transistor having a source connected to the first input, a gate connected to the first intermediate node and a drain connected to the second intermediate node; and a first conduction type thirteenth transistor having a source connected to the second intermediate node, a gate connected to the fourth input and a drain connected to the first output.

A voltage generating circuit having a boosting circuit for generating a voltage higher than a power source voltage, a negatively boosting circuit for generating a voltage lower than the ground voltage by using the power source voltage, and a reference voltage generating circuit for generating a reference voltage, a desired voltage being generated on the basis of the reference voltage, characterized by comprising:

a first external voltage applying circuit having means for carrying out a switching operation between an external applied voltage and the power source voltage in accordance with a first external voltage applying signal; a first voltage variation detecting circuit that has an eleventh input connected to the output of the boosting circuit, a twelfth input connected to the output of the first external voltage applying circuit, and a thirteenth input connected to the ground, and generates a first control voltage at a first output; a first differential amplifying circuit for comparing the first control voltage and the reference voltage; a first clamp circuit for controlling the output voltage of the boosting circuit in accordance with the output of the first differential amplifying circuit; a second external voltage applying circuit having means for carrying out a switching operation between the external applied voltage and the power source voltage in accordance with a second external voltage applied signal; a third voltage variation detecting circuit that has a thirty first input connected to the power source, a thirty second input connected to the output of the negatively boosting circuit and a thirty third input connected to the ground, and generates a third control voltage at a third output; a third differential amplifier circuit for comparing the third control voltage and the reference voltage; and a second clamp for controlling the output voltage of the negatively boosting circuit in accordance with the output of the third differential amplifier circuit.

According to claim 45, a voltage generating circuit having a boosting circuit for generating a voltage higher than a power source voltage, a negatively boosting circuit for generating a voltage lower than the ground voltage by using the power source voltage, and a reference voltage generating circuit for generating a reference voltage, a desired voltage being generated on the basis of the reference voltage, is characterized by comprising: a first external voltage applying circuit having means for carrying out a switching operation between an external applied voltage and the power source voltage in accordance with a first external voltage applying signal; a first voltage variation detecting circuit that has an eleventh input connected to the output of the boosting circuit, a twelfth input connected to the output of the first external voltage applying circuit, and a thirteenth input connected to the ground, and generates a first control voltage at a first output; a first differential amplifying circuit for comparing the first control voltage and the reference voltage; a first clamp circuit for controlling the output voltage of the boosting circuit in accordance with the output of the first differential amplifying circuit; a first level shift circuit for receiving the output voltage of the boosting circuit and outputting a level-shifted voltage; a second voltage variation detecting circuit that has a twenty first input connected to the output of the first level shift circuit, a twenty second input connected to the power source and a twenty third input connected to the ground, and generates a second control voltage at a second output; a second differential amplifier circuit having means for comparing the second control voltage and the reference voltage with each other and control the first level shift circuit so that a desired voltage is output from the output of the first level shift circuit; a second external voltage applying circuit having means for carrying out a switching operation between the external applied voltage and the power source voltage in accordance with a second external voltage applying signal; a third voltage variation detecting circuit that has a thirty first input connected to the power source, a thirty second input connected to the output of the negatively boosting circuit and a thirty third input connected to the ground, and generates a third control voltage at a third output; a third differential amplifier circuit for comparing the third control voltage and the reference voltage; a second clamp for controlling the output voltage of the negatively boosting circuit in accordance with the output of the third differential amplifier circuit; a second level shift circuit for receiving the output voltage of the negatively boosting circuit and outputting a level-shifted voltage; a fourth voltage variation detecting circuit that has a forty first input connected to the power source, a forty second input connected to the output of the second level shift circuit and a forty third input connected to the ground and generates a fourth control voltage at a fourth output; and a fourth differential amplifier circuit having means for comparing the fourth control voltage and the reference voltage with each other and controlling the second level shift circuit so that a desired negative voltage is output from the output of the second level shift circuit.

According to claim 46, the voltage generating circuit is characterized in that the reference voltage generating circuit has a reference voltage generating unit for generating a reference voltage, and a trimming circuit unit for receiving a trimming signal and changing the voltage level of the reference voltage to generate a reference voltage.

According to claim 47, the voltage generating circuit is characterized in that the reference voltage generating circuit has a reference voltage generating unit for generating a reference voltage and a trimming circuit unit having means for receiving a trimming signal and changing the voltage level of the reference voltage to generate a reference voltage, and the voltage generating circuit further comprises: a third level shift circuit for receiving the ground voltage and outputting a level-shifted voltage; a fifth voltage variation detecting circuit that has a fifty first input connected to the power source, a fifty second input connected to the output of the third level shift circuit, and a fifty third input connected to the ground and generates a fifth control voltage at a fifth output; and a fifth differential amplifier circuit for comparing the fifth control voltage and the reference voltage and controlling the third level shift circuit so that a voltage dropped from the power source voltage between the power source voltage and the ground voltage is output from the output of the third level shift.

DESCRIPTION OF THE PREFERRED EMBODIMENTS

A voltage generating circuit according to an embodiment of the present invention will be described with reference to the drawings.

(First Embodiment)

Figure 1:
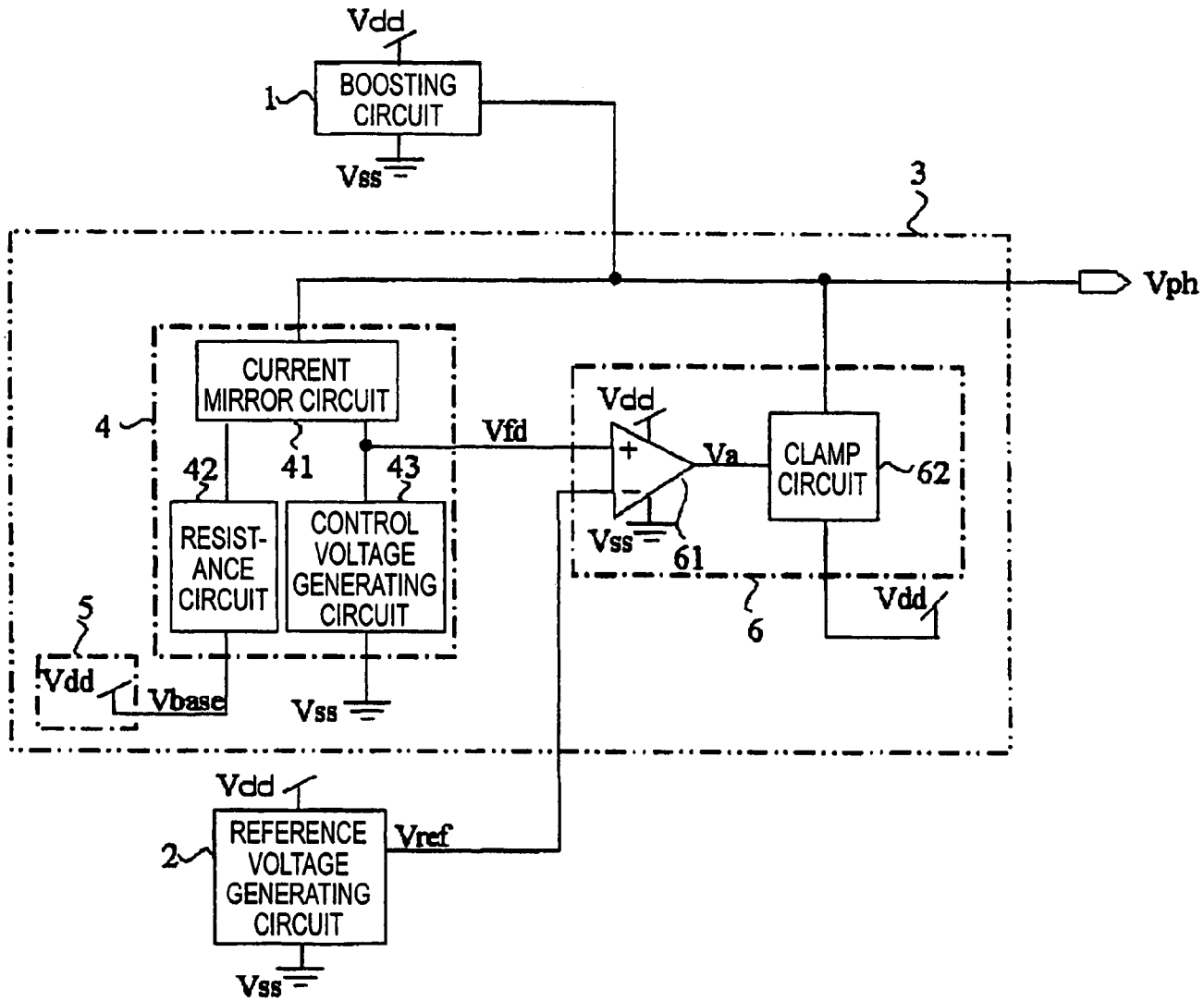
FIG. 1 shows a limiter circuit according to a first embodiment of the present invention.

A voltage generating circuit according to a first embodiment of the invention will be described. FIG. 1 is a block diagram showing the construction of the voltage generating circuit according to the first embodiment.

In FIG. 1, 1 represents a boosting circuit for boosting a power source voltage Vdd to a voltage of the power source voltage Vdd or more, 2 represents a reference voltage generating circuit for generating a reference voltage Vref from the power source voltage Vdd, 3 represents a limiter circuit for clamping the voltage output from the boosting circuit to a desired boosted voltage Vph, 4 represents a voltage variation detecting circuit for converting the potential difference between the boosted voltage Vph and the power source voltage Vdd to current and then generating a control voltage Vfd with a ground voltage Vss as a reference, 41 represents a current mirror circuit, 42 represents a resistance circuit, 43 represents a control voltage generating circuit, 5 represents a reference voltage Vbase for determining voltage-dependence of the boosted voltage Vph, 6 represents a control circuit, 61 represents a differential amplifier circuit for receiving a reference voltage Vref and a control voltage Vfd to carry out differential amplification, and 62 represents a clamp circuit for extracting the boosted voltage Vph to the power source Vdd by the output voltage Va of the differential amplifier circuit 61 to set the boosted voltage Vph to a desired voltage.

Next, the operation of the voltage generating circuit according to the first embodiment will be described. When the boosting circuit 1 generates a voltage higher than the power source voltage Vdd, the potential difference (Vph−Vbase) occurs between the boosted voltage Vph and the reference voltage Vbase. The potential difference (Vph−Vbase) is converted to current by the current mirror 41 and the resistance circuit 42, and the reference current corresponding to the current flowing in the resistance circuit 42 is generated by the current mirror circuit 41. The reference current thus generated flows into the control voltage generating circuit 43 to generate the control voltage Vfd serving as the ground voltage reference. The reference voltage Vref generated in advance and the control voltage Vfd are compared with each other in the differential amplifier circuit 61 to control the clamp circuit 62 and set the boosted voltage Vph to a desired voltage.

Figure 2:
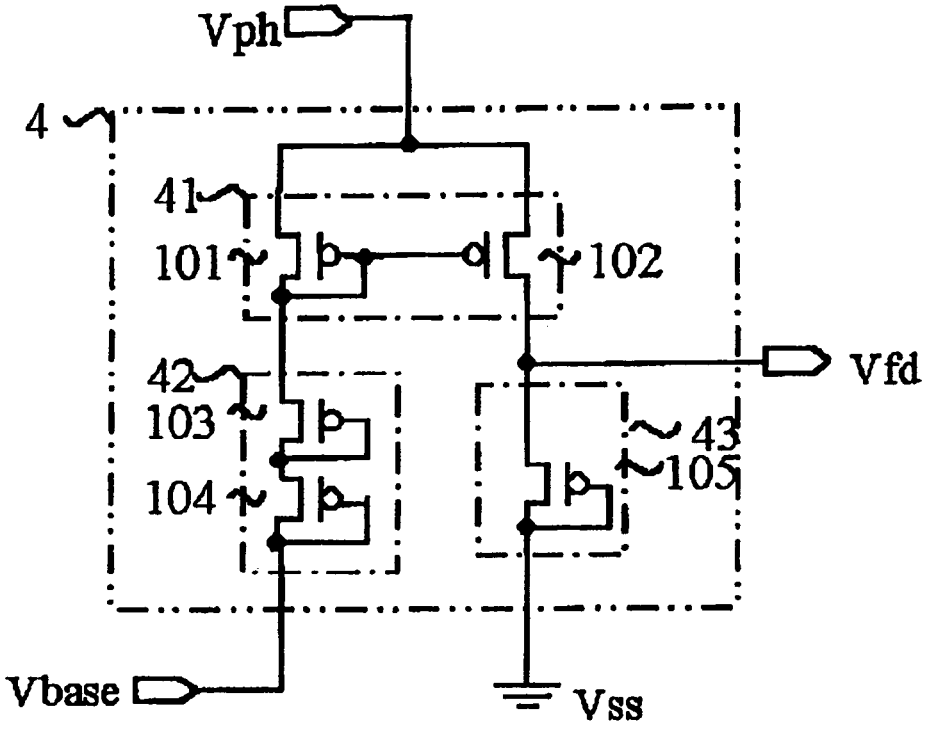
FIG. 2 shows a voltage variation detecting circuit according to the first embodiment of the present invention.

FIG. 2 is a circuit diagram showing an example of the construction of the voltage variation detecting circuit 4 of the voltage generating circuit according to the first embodiment. Each of 101, 102, 103, 104, 105 comprises a P-type MOS transistor. It is assumed that the P-type MOS transistors 101, 102, 103, 104, 105 are designed to have the same size. The potential difference (Vph−Vbase) generated between the boosted voltage Vph and the reference voltage Vbase is divided to the P-type MOS transistors 101, 103, 104, and each divided voltage Vgs is equal to (Vph−Vbase)/(three-stage diode connection). The current corresponding to Vgs is made to flow into the P-type MOS transistor 105 by the current mirror circuit 41 to generate the control voltage Vfd (=Vgs). The reference voltage Vref generated in advance and the control voltage Vfd are compared with each other in the differential amplifier circuit 61 to control the clamp circuit 62 and set the boosted voltage Vph to a desired voltage. Through the above operation, Vref=Vfd is satisfied. Therefore, Vref=((Vph−Vbase)/(three-stage diode connection)) is satisfied, and the boosted voltage Vph is set to the voltage of ((three-stage diode connection)×Vref+Vbase). Accordingly, when P-type MOS transistors of N stages (N≧1) are connected to one another in series in the resistance circuit 42, the boosted voltage Vph is set to ((N+1)×Vref+Vbase).

Figure 3:
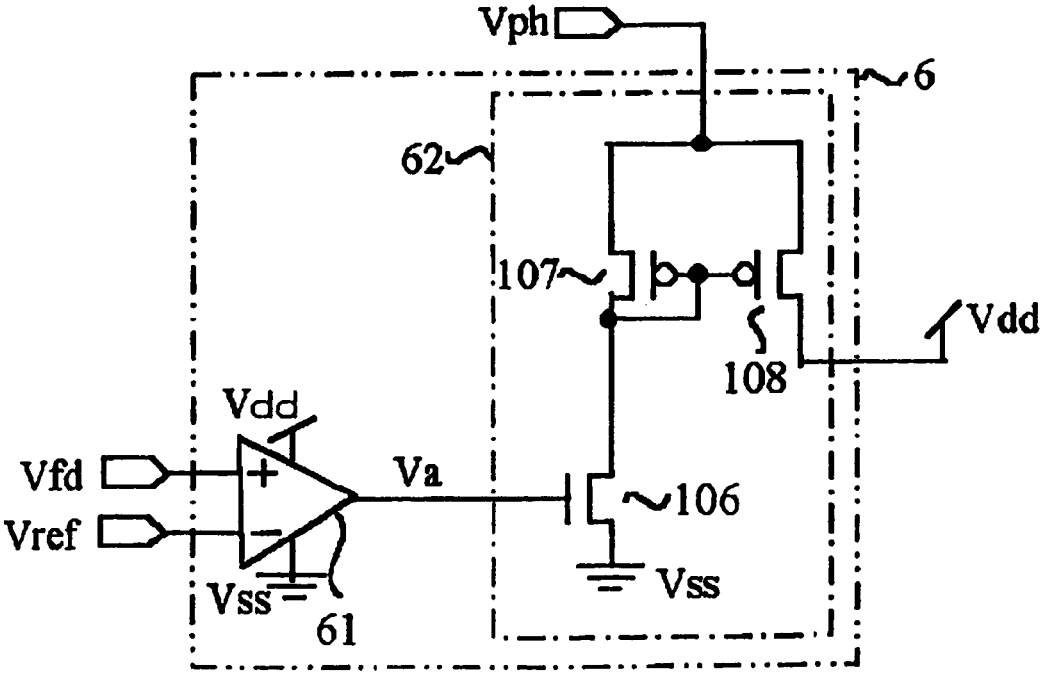
FIG. 3 shows a control circuit according to the first embodiment of the present invention.

FIG. 3 is a circuit diagram showing an example of the construction of a control circuit 6 of the voltage generating circuit according to the first embodiment. 106 represents an N-type MOS transistor in which the drain current corresponding to the output voltage of the differential amplifier circuit 61 flows, 107 represents a P-type MOS transistor for generating Vgs corresponding to the drain current of the N-type MOS transistor 106, and 108 represents a P-type MOS transistor that acts to extract the boosted voltage Vph to the power source voltage Vdd when Vgs of the P-type MOS transistor 107 is applied to the P-type MOS transistor 108. The reference voltage Vref generated in advance and the control voltage Vfd are compared with each other in the differential amplifier circuit 61 which is driven with the power source voltage, and the drain current corresponding to the output voltage Va of the differential amplifier circuit 61 is made to flow into the N-type MOS transistor 106, so that the amount of current to be extracted from the boosted voltage Vph to the power source voltage Vdd is adjusted by the P-type MOS transistor 108, and thus the boosted voltage Vph is set to the desired voltage.

As described above, the voltage generating circuit of the first embodiment is equipped with the voltage variation detecting circuit 4 having the current mirror circuit 41, the resistance circuit 42 and the control voltage generating circuit 43, whereby a high-precision boosted voltage Vph dependent on the reference voltage Vbase (=Vdd) can be achieved.

Furthermore, the differential amplifier circuit 61 driven by the power source voltage Vdd is equipped, so that the current to be consumed by the boosted voltage Vph can be reduced and thus the waste power consumption of the power source voltage Vdd by the power source Vdd can be reduced.

In the first embodiment, the voltage variation detecting circuit 4 has been described. However, this is an example, and another voltage variation detecting circuit may be used. Such other voltage variation detecting circuits are shown in FIGS. 4, 5 and 6.

Figure 4:
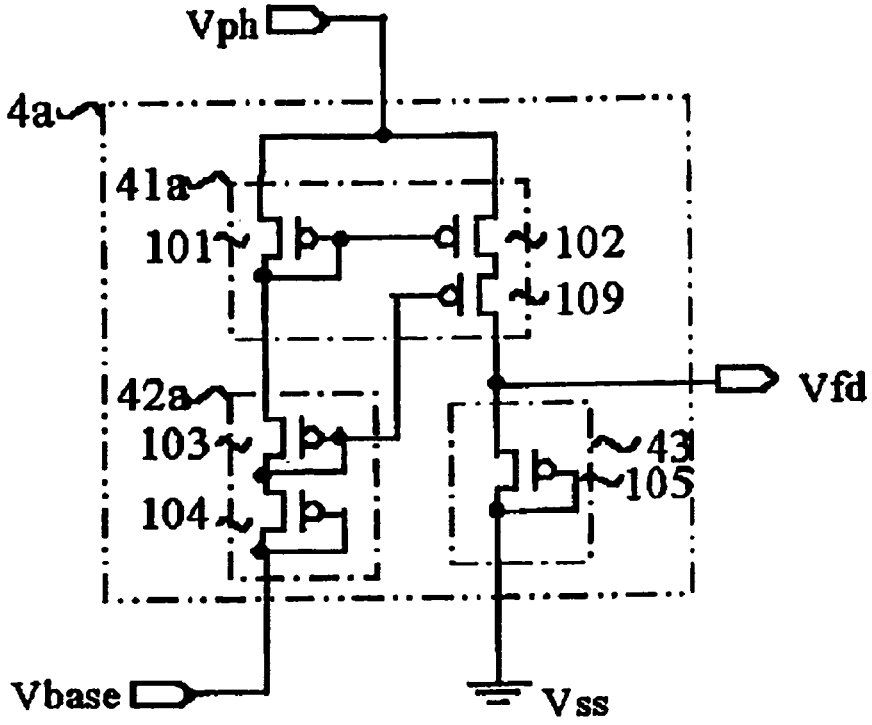
FIG. 4 shows the voltage variation detecting circuit according to the first embodiment of the present invention.

For example, the same operation as the voltage variation detecting circuit 4 shown in FIG. 2 is achieved by a voltage variation detecting circuit 4*a* equipped with a current mirror circuit 41*a* having a P-type MOS transistor 109 supplied with any terminal voltage of a resistance circuit 42*a* as shown in FIG. 4.

Furthermore, the voltage variation detecting circuit 4*a* has a P-type MOS transistor 109 supplied with any terminal voltage of the resistance circuit 42*a* to suppress variation of the drain voltage of the P-type MOS transistor 102. Therefore, the current ratio between the drain current of the P-type MOS transistor 101 and the drain current of the transistor 102 can be kept constant irrespective of the voltage level of the boosted voltage Vph. Accordingly, the boosted voltage Vph can be set to a desired voltage with higher precision as compared with the voltage variation detecting circuit 4.

Figure 5:
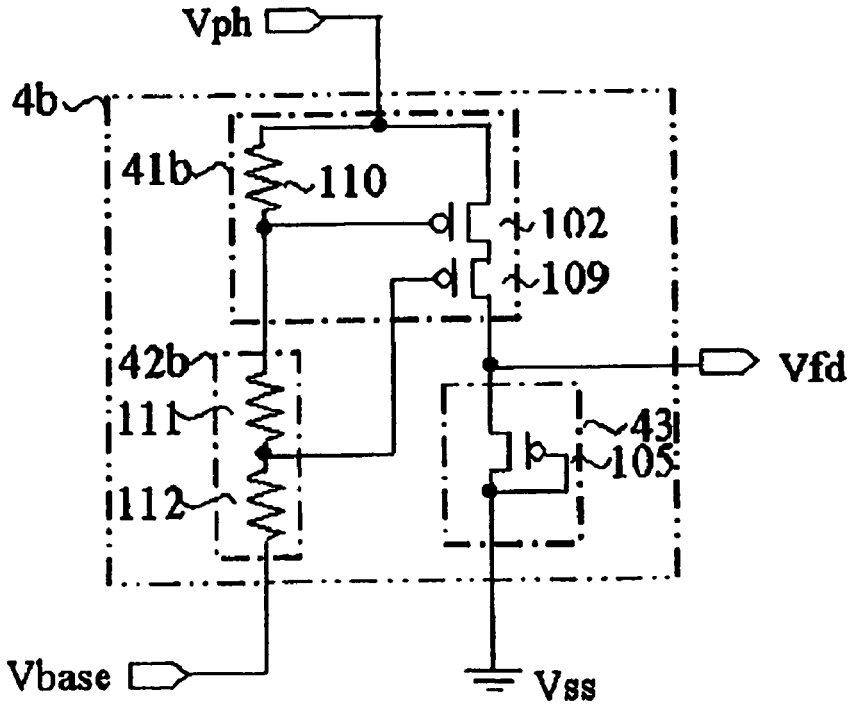
FIG. 5 shows another voltage variation detecting circuit (part 1) of the first embodiment according to the present invention.
Figure 6:
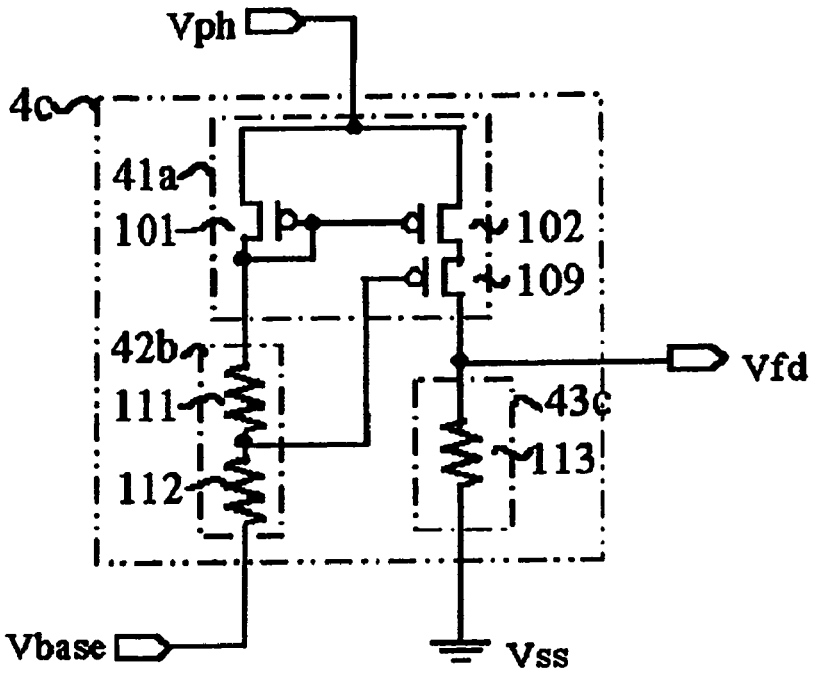
FIG. 6 shows another voltage variation detecting circuit (part 2) of the first embodiment according to the present invention.

Still furthermore, the same operation as the voltage variation detecting circuit 4 shown in FIG. 2 can be achieved by a voltage variation detecting circuit 4*b* equipped with the current mirror circuit 41*b* having the P-type MOS transistor 109 supplied with any terminal voltage of the resistance circuit 42*b* in which the P-type MOS transistor 101 shown in FIG. 2 is replaced by a resistor 110 and the P-type MOS transistors 103 and 104 are replaced by resistors 111, 112 as shown in FIG. 5.

Furthermore, the same operation as the voltage variation detecting circuit 4 shown in FIG. 2 is also achieved by a voltage variation detecting circuit 4*c* equipped with the current mirror circuit 41*a* having the P-type MOS transistor 109 supplied with any terminal voltage of the resistance circuit 42*b* in which the P-type MOS transistors 103 and 104 shown in FIG. 3 are replaced by resistors 111, 112 and the P-type MOS transistor 105 is replaced by a resistor 113 as shown in FIG. 6.

As described above, the voltage variation detecting circuits 4, 4*a*, 4*b*, 4*c* shown in FIGS. 2, 4 to 6 are described as examples of the voltage variation detecting circuit, however, the voltage variation detecting circuit is not limited to these examples insofar as the same operation as the voltage variation detecting circuits 4, 4*a*, 4*b*, 4*c* is achieved.

Figure 7:
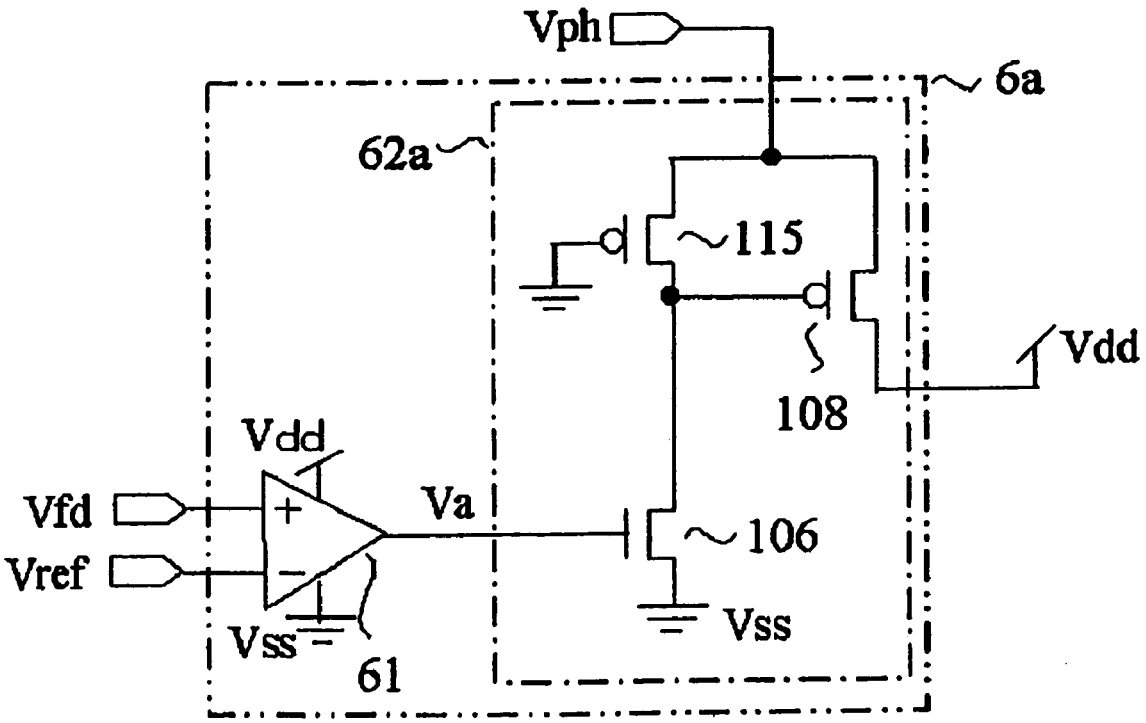
FIG. 7 shows another control circuit (part 1) of the first embodiment according to the present invention.
Figure 8:
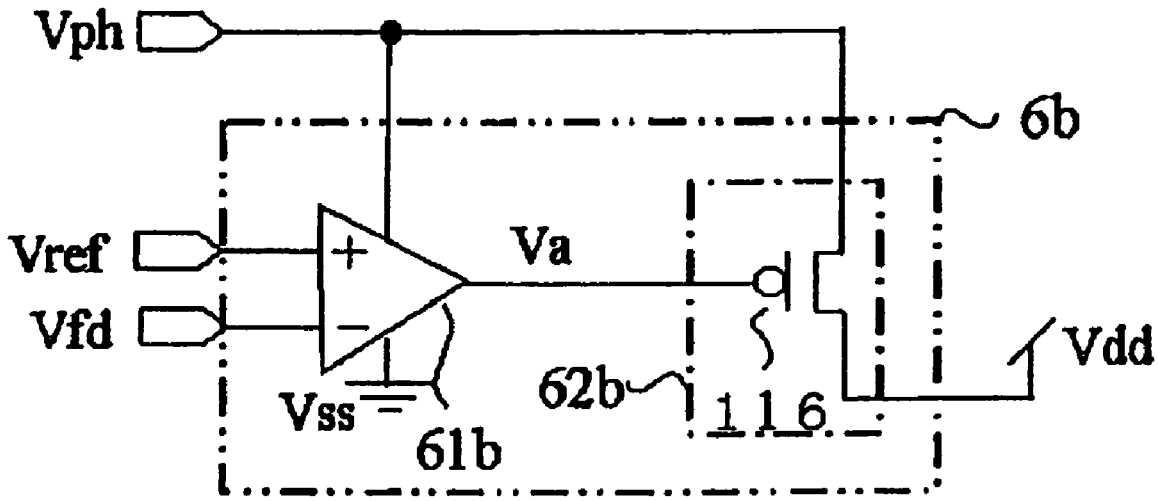
FIG. 8 shows another control circuit (part 2) of the first embodiment according to the present invention.

FIGS. 7 and 8 are circuit diagrams shown other examples of the control circuit. For example, in FIG. 7, the same operation as the control circuit 6 shown in FIG. 3 is achieved by a control circuit 6*a* designed so that the P-type MOS transistor 107 shown in FIG. 3 is replaced by a P-type MOS transistor 115 having a gate connected to the ground.

Furthermore, in an example shown in FIG. 8, the same operation as the control circuit 6 shown in FIG. 3 is achieved by a control circuit 6*b* in which the differential amplifier circuit 61 shown in FIG. 3 is driven with the boosted voltage Vph and the clamp circuit 62 is replaced by a P-type MOS transistor 116.

The control circuit 6*b* does not have any current mirror circuit which is used in the clamp circuit 62, and thus a circuit design having higher response can be performed as compared with the control circuit 6. Accordingly, this example may be applied to a circuit having quick load variation.

(Second Embodiment)

Figure 9:
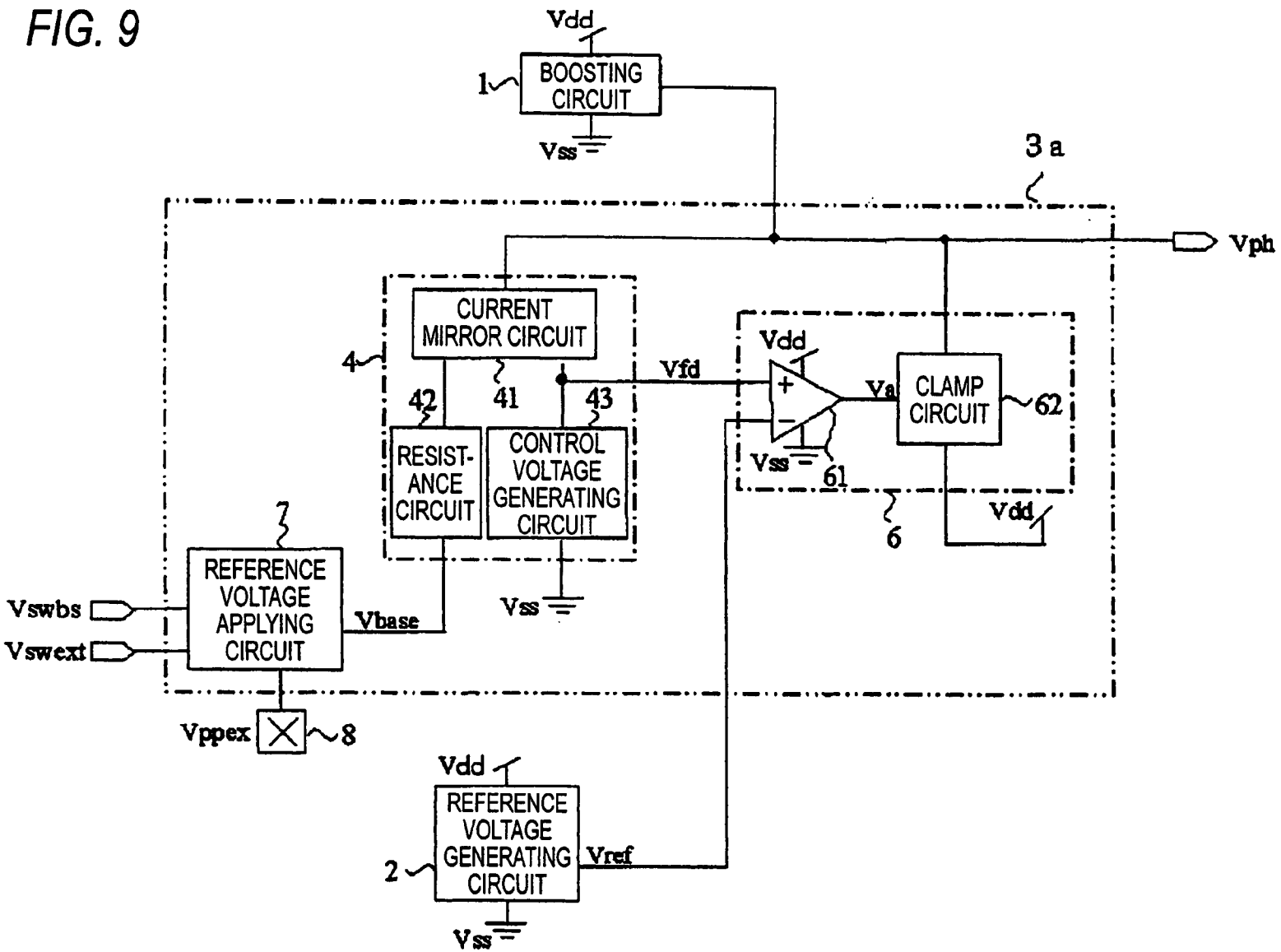
FIG. 9 shows a limiter circuit according to a second embodiment of the present invention.

A voltage generating circuit according to a second embodiment of the present invention will be described with reference to the drawings. FIG. 9 is a block diagram showing the construction of the voltage generating circuit according to the second embodiment.

In FIG. 9 the same reference numerals as FIG. 1 represent the same or corresponding parts.

The voltage generating circuit according to the second embodiment is characterized in that the voltage generating circuit according to the first embodiment is equipped with a limiter circuit 3*a* using a reference voltage applying circuit 7 that can switch the reference voltage Vbase on the basis of a reference voltage switching signal Vswbs and set to the reference voltage Vbase the external applied voltage applied from the pad 8 on the basis of an external voltage applying signal Vswext.

Figure 10:
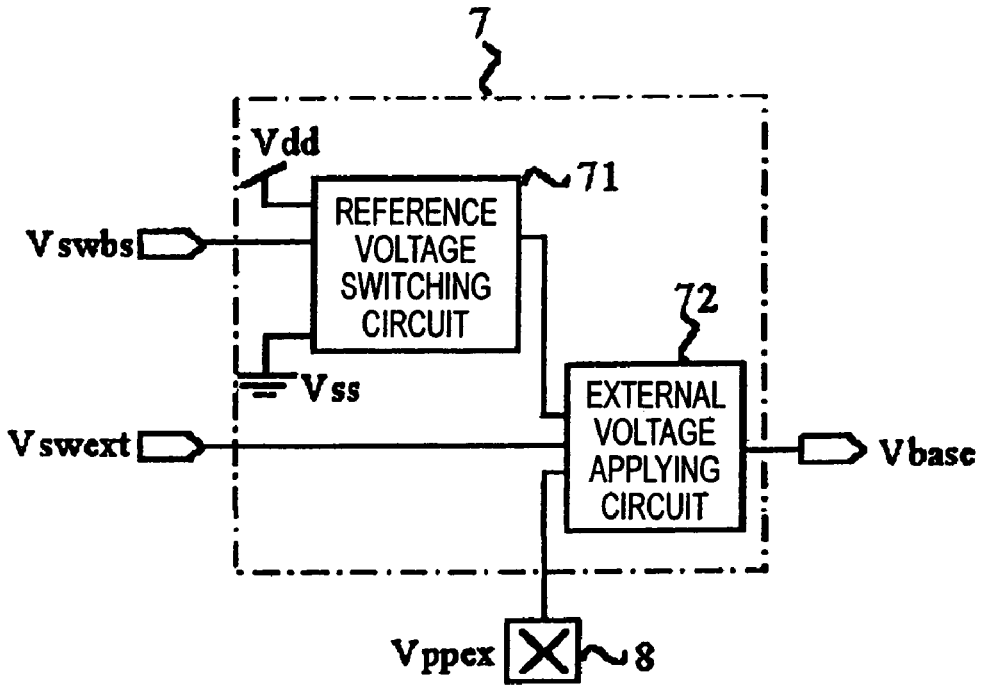
FIG. 10 shows a reference voltage applying circuit according to the second embodiment of the present invention.

FIG. 10 is a circuit diagram showing an example of the reference voltage applying circuit 7 according to the second embodiment. In FIG. 10, 71 represents a reference voltage switching circuit for switching the internal voltage on the basis of the reference voltage switching signal Vswbs, and 72 represents an external voltage applying circuit for carrying out the switching operation between the internal voltage and the external applied voltage Vppx on the basis of the external voltage applying signal Vswext.

Furthermore, in the reference voltage applying circuit 7 of FIG. 10, the power source voltage Vdd or ground voltage Vss is output to the reference voltage switching circuit 71 on the basis of the reference voltage switching signal Vswbs, and any one of the output voltage of the reference voltage switching circuit 71 and the external applied voltage Vppex is selected on the basis of the external voltage applying signal Vswext and set as the reference voltage Vbase.

Next, the operation of the voltage generating circuit according to the second embodiment will be described. The operations of the circuits other than the reference voltage applying circuit 7 are the same as the first embodiment except that the reference voltage Vbase is not fixed to the power source voltage Vdd, but switchable by the reference voltage applying circuit 7, and thus the description on the same operations is omitted.

In the reference voltage applying circuit 7, the reference voltage Vbase corresponding to the output voltage of the reference voltage applying circuit 7 is equal to any one of the power source voltage Vdd, the ground voltage Vss and the external applied voltage Vppex.

In the resistance circuit 42, when P-type MOS transistors of N stages ($N \geqq 1$) are connected to one another in series, that is, diode connection is established among these P-type MOS transistors, the boosted voltage Vph is set to $((N+1)\times Vref+Vbase)$, so that the voltage-dependence of the boosted voltage Vph can be arbitrarily set by the reference voltage switching signal Vswbs and the external voltage applying signal Vswext.

As described above, according to the voltage generating circuit of the second embodiment, the same effect as the first embodiment is achieved, also the reference voltage Vbase is switched to the power source voltage Vdd, the ground voltage Vss, the external applied voltage Vppex or the like on the basis of the reference voltage switching signal Vswbs and the external voltage applied signal Vswext. Therefore, the voltage dependence of the boosted voltage Vph can be arbitrarily switched like it is switched to $((N+1)\times Vref+Vdd: N \geqq 1)$, $((N+1)\times Vref+Vss: N \geqq 1)$ or $((N+1)\times Vref+Vppex: N \geqq 1)$ or the like.

Accordingly, even when the voltage-dependence of the boosted voltage for optimizing the circuit characteristic is varied in accordance with the operation mode such as data deletion, data writing, data reading or the like and the circuit itself like a non-volatile semiconductor storage device, the voltage-dependence of the boosted voltage can be switched as occasion demands, so that the circuit characteristic can be enhanced.

In addition, plural voltage-dependent boosted voltages are switched to one another, and supplied the switched one to the circuit, so that the area of the circuit can be reduced.

Furthermore, the voltage $((N+1)\times Vref+Vppex: N \geqq 1)$ which is dependent on the external applied voltage and higher than the external applied voltage can be generated as the boosted voltage Vph by the external voltage applying signal Vswext. Therefore, when the external voltage corresponding to the boosted voltage is required for estimation or the like of the characteristic of a memory cell in the non-volatile semiconductor storage device or the like, it is sufficient to apply the voltage corresponding to the power source voltage from the pad, so that surge breaking occurring in the pad or the device at the application time of a high voltage can be eliminated.

In the second embodiment, the reference voltage applying circuit 7 shown in FIG. 10 has been described as the reference voltage applying circuit. However, this is an example, and another reference voltage applying circuit may be used.

Figure 11:
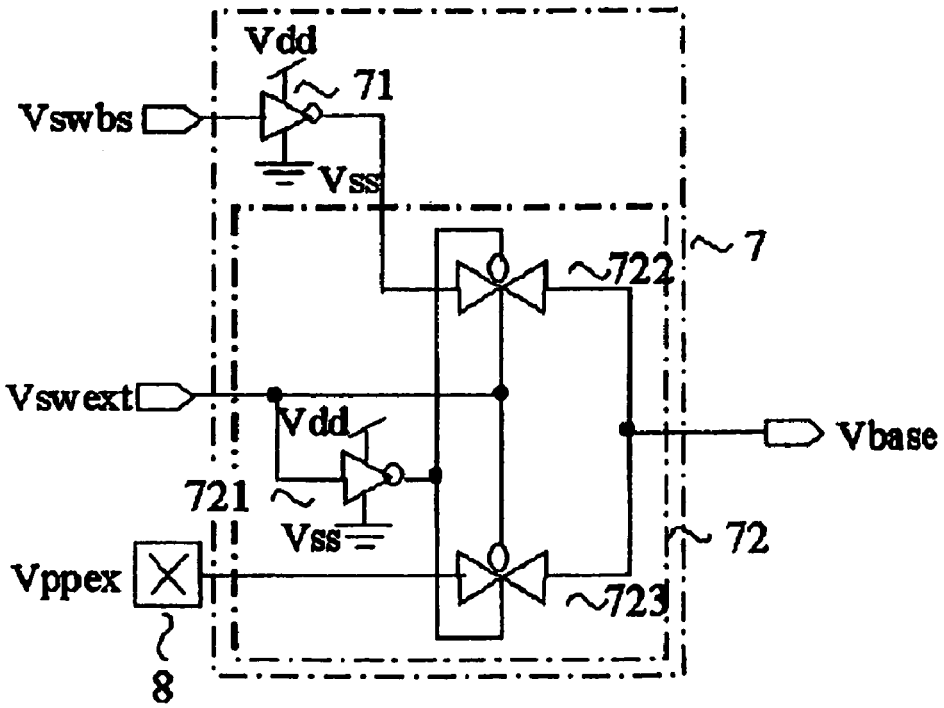
FIG. 11 shows another reference voltage applying circuit (part 1) according to the second embodiment of the present invention.

FIG. 11 shows a reference voltage applying circuit designed so that the reference voltage switching circuit 71 shown in FIG. 10 is replaced by an inverter circuit and the external voltage applying circuit 72 is replaced by transfer gate circuits 722 and 723 and an inverter circuit 721 for controlling the transfer gate circuits.

Figure 12:
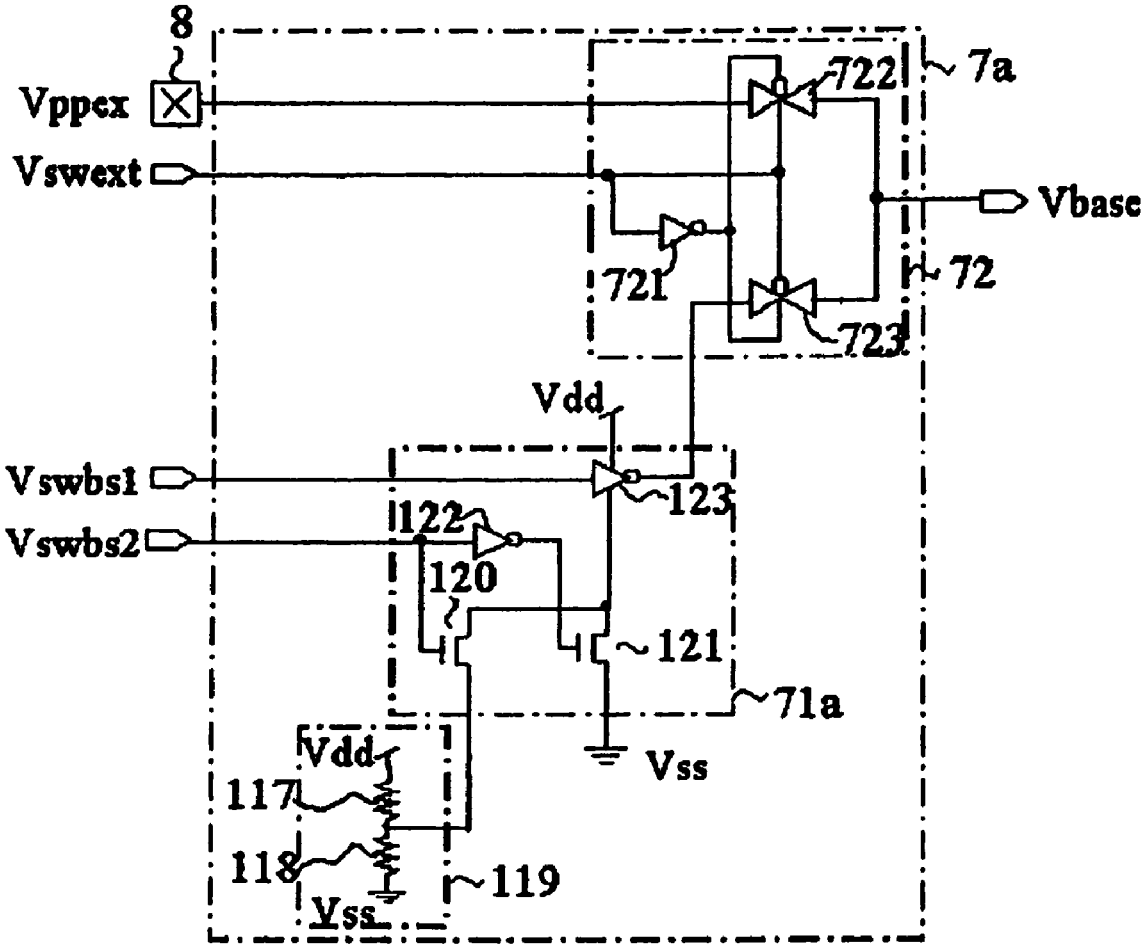
FIG. 12 shows another reference voltage applying circuit (part 2) according to the second embodiment of the present invention.

In FIG. 12, the number of voltages usable as the reference voltage Vbase is increased by using reference voltage switching signals Vswbs1, Vswbs2.

Furthermore, in addition to the power source voltage Vdd and the ground voltage Vss, the external applied voltage Vpp, a reference voltage generated by a voltage dividing circuit 119 comprising a resistor 117 and a resistor 118 is added as the reference voltage Vbase.

The reference voltage switching circuit 71*a* comprises N-type MOS transistors 120, 121 and inverter circuits 123 and 124.

If the same operation as the case where the power source voltage Vdd, the ground voltage Vss or the like as described above is used can be achieved, another voltage serving as a reference voltage may be used as the reference voltage Vbase.

(Third Embodiment)

Figure 13:
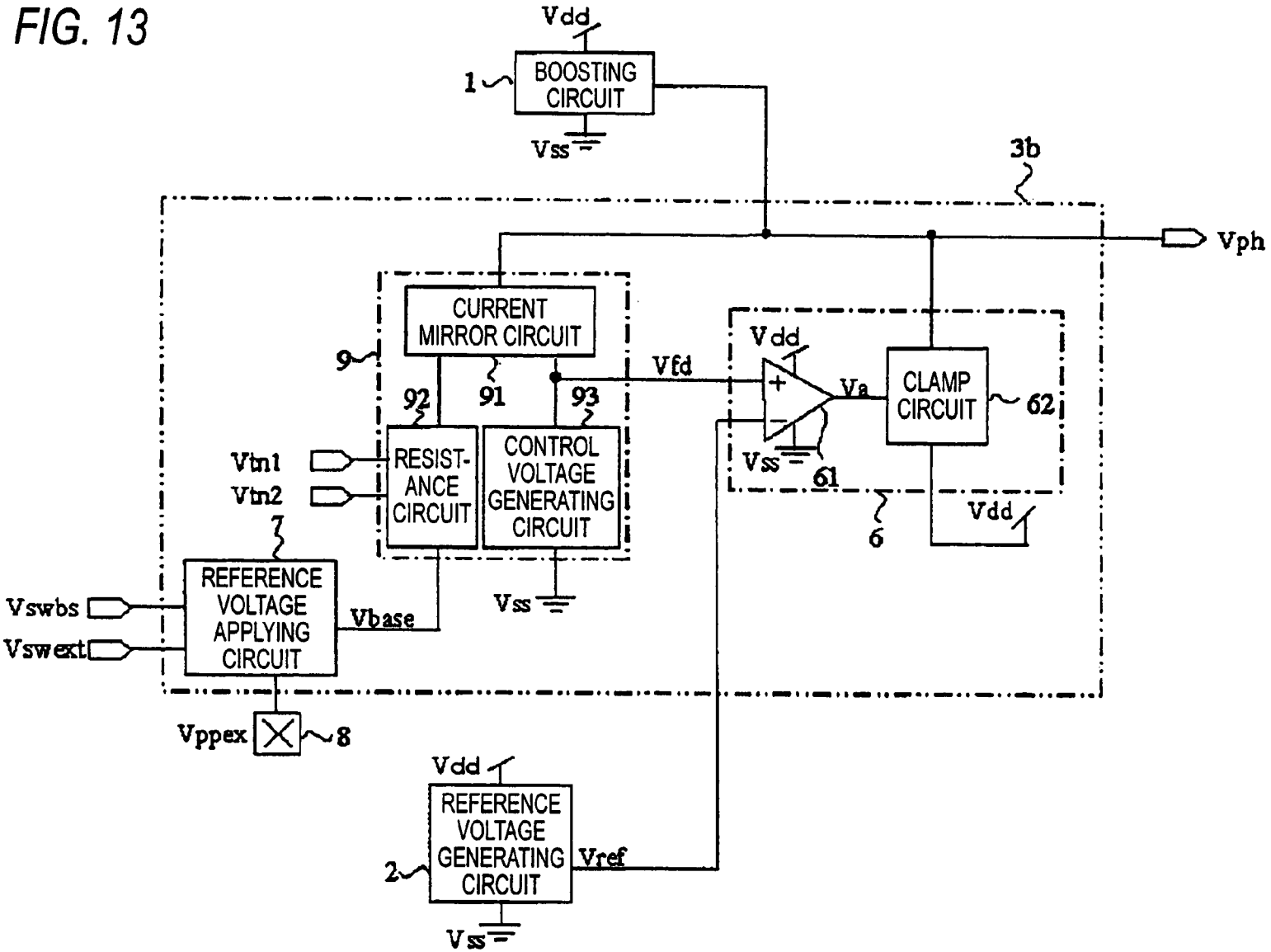
FIG. 13 shows a limiter circuit according to a third embodiment of the present invention.

A voltage generating circuit according to a third embodiment of the present invention will be described hereunder. FIG. 13 is a block diagram showing the construction of a voltage generating circuit according to the third embodiment.

In FIG. 13, the same reference numerals as FIG. 9 represent the same or corresponding parts.

The voltage generating circuit according to the third embodiment is characterized in that the voltage generating circuit according to the second embodiment is equipped with a limiter circuit 3*b* using a voltage variation detecting circuit 9 which comprises a resistance circuit 9 having a resistance value variable by set voltage switching signals Vtn1, Vtn2, a current mirror circuit 91 and a control voltage generating circuit 93.

Figure 14:
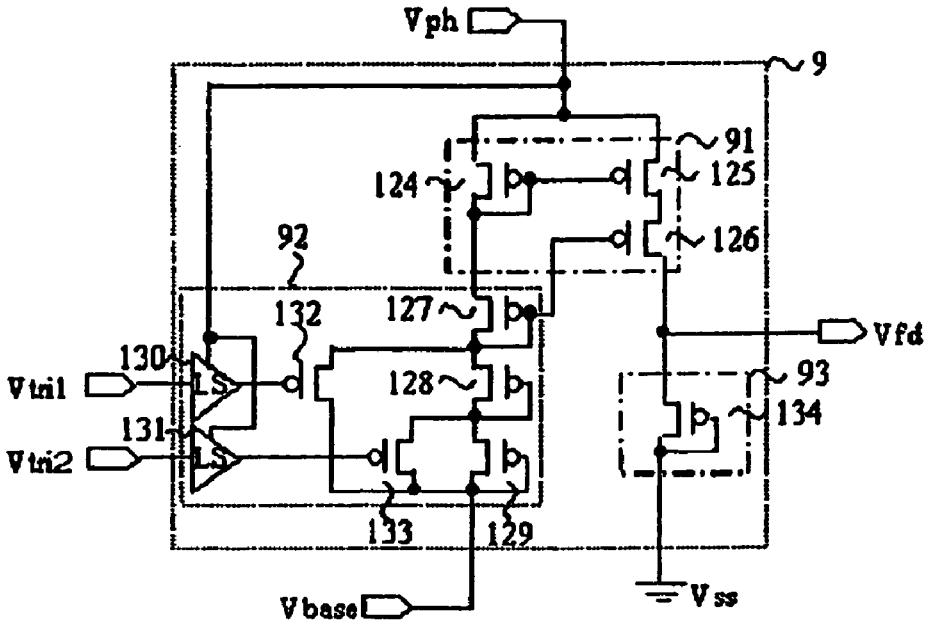
FIG. 14 shows a voltage variation detecting circuit according to the third embodiment of the present invention.

FIG. 14 is a circuit diagram showing an example of the construction of the voltage variation detecting circuit 9 according to the third embodiment. In FIG. 14, 91 represents a current mirror circuit comprising P-type MOS transistors 124, 125, 126, 92 represents a resistance circuit comprising the resistance portions of P-type MOS transistors 127, 128, 129, P-type MOS transistors for short-circuiting the respective resistance portions to one another, and level-shift circuits 130, 131 for carrying out the switching operation between the boosted voltage Vph and the ground voltage in accordance with the set voltage switching signal and outputting the switched one voltage, and 93 represents a control voltage generating circuit comprising a diode-connected P-type MOS transistors 134.

Next, the operation of the voltage generating circuit according to the third embodiment will be described.

The operations of the circuits other than the voltage variation detecting circuit 9 are the same as the second embodiment except that the voltage variation detecting circuit 4 is replaced by the voltage variation detecting circuit 9, and the description on the same operation is omitted.

In the voltage variation detecting circuit 9, the level-shift circuits 130 and 131 output the boosted voltage Vph or the ground voltage in accordance with the set voltage switching signal Vtr1 or Vtri2, and the P-type MOS transistors 132 and 133 are set to a conduction state or non-conduction state in accordance with the output of the level-shift circuits 130 and 131.

Accordingly, the number of stages N of diode-connected transistors of the resistance circuit 92 is switched by the set voltage switching signal Vtri1 or Vtri2. Since the boosted voltage Vph is set to ((N+1)×Vref+Vbase:N≧1), the boosted voltage Vph can be switched by the set voltage switching signal Vtri1 or Vtri2 with keeping any voltage-dependence.

As described above, according to the voltage generating circuit of the third embodiment, the voltage level of the boosted voltage Vph can be switched with keeping any voltage-dependence by the set voltage switching signal while the same effect as the second embodiment can be achieved.

Accordingly, the boosted voltages of plural voltage levels can be generated with respect to the boosted voltage Vph having each voltage-dependence by using the same circuit, and thus the circuit area can be reduced.

The third embodiment is associated with the description of the voltage variation detecting circuit 9. However, this is an example, and another voltage variation detecting circuit may be used.

Figure 15:
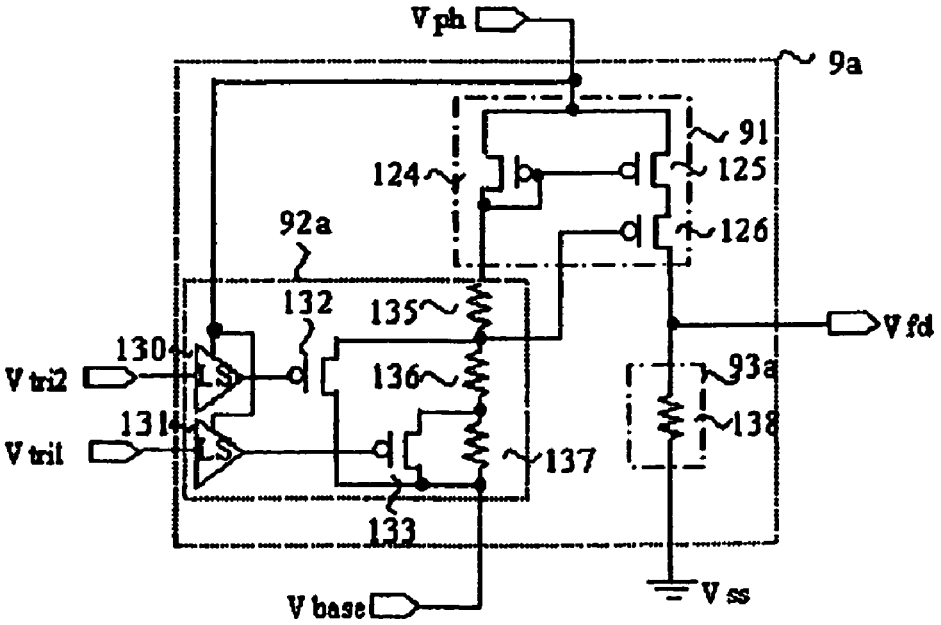
FIG. 15 shows another voltage variation detecting circuit (part 1) of the third embodiment according to the present invention.
Figure 16:
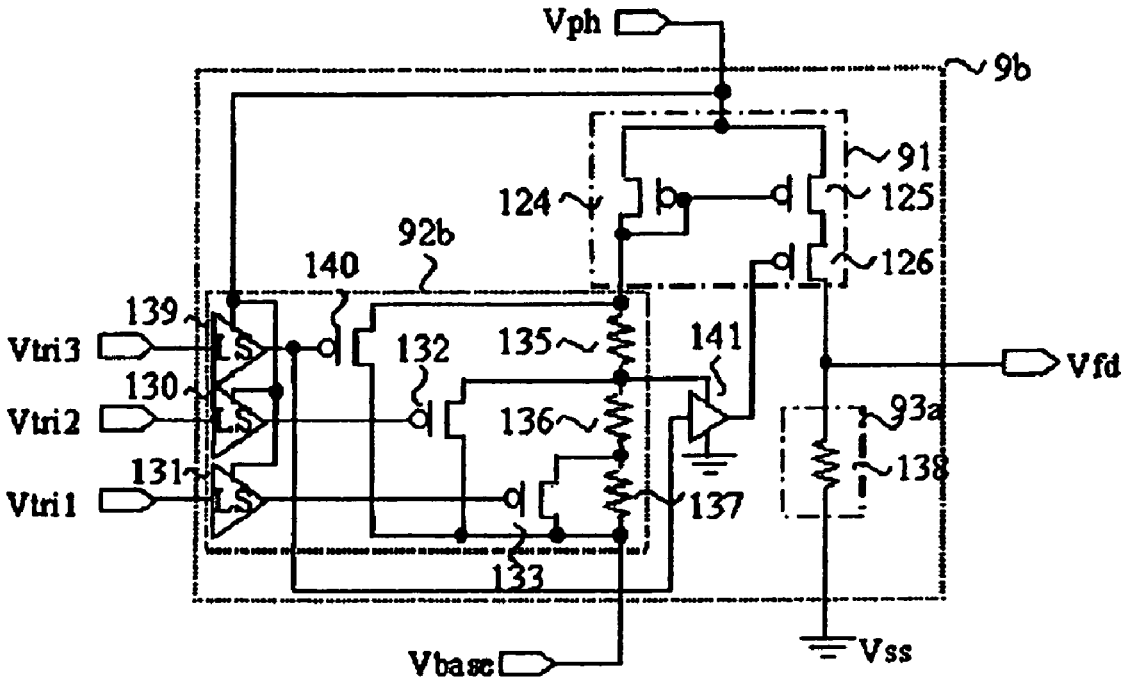
FIG. 16 shows another voltage variation detecting circuit (part 2) of the third embodiment according to the present invention.

FIGS. 15, 16 are circuit diagrams showing other examples of the construction of the voltage variation detecting circuit. FIG. 15 shows a voltage variation detecting circuit 9*a* which is constructed so that the P-type MOS transistors 127, 128, 129 and 134 shown in FIG. 14 is replaced by resistors 135, 136, 137, 138, whereby the same operation as the voltage variation detecting circuit shown in FIG. 14 is achieved.

FIG. 16 shows a voltage variation detecting circuit 9*b* which is constructed so that the P-type MOS transistors 127, 128, 129 and 134 shown in FIG. 14 are replaced by resistors 135, 136, 137, 138, and further equipped with a set voltage switching signal Vtri3, a level shift circuit 139, a P-type MOS transistor 140 and a buffer circuit 141.

The operation of the voltage variation detecting circuit 9*b* of FIG. 16 will be described. The operation of the voltage variation detecting circuit 9*b* on the basis of the set voltage switching signals Vtri1 and Vtri2 is the same as the voltage variation detecting circuit 9 shown in FIG. 14, and thus the description thereof is omitted.

When the P-type MOS transistor 140 is under non-conduction state, the voltage between the resistor 135 and the resistor 136 is applied to the gate of the P-type MOS transistor 126 by the buffer circuit 141. Subsequently, when the P-type MOS transistor 140 is set to a conduction state by the set voltage switching signal Vtri3, the voltage between the resistor 135 and the resistor 136 is set to the same voltage as the drain voltage of the P-type MOS transistor 124.

On the other hand, the ground voltage is applied to the gate of the P-type MOS transistor 126 by the buffer circuit, so that the P-type MOS transistor 125 is allowed to be driven under saturated state. Therefore, even when the boosted voltage Vph is equal to (Vref+Vbase), a high-precision boosted voltage Vph can be achieved.

In the voltage variation detecting circuit 9*b*, on the basis of the set voltage switching signal, the gate voltage of the P-type MOS transistor for suppressing the variation of the drain current used in the current mirror circuit in the voltage variation detecting circuit is switched between the case where the boosted voltage Vph to be set is equal to ((N+1)×Vref+Vbase:N≧1) and the case where it is equal to (Vref+Vbase), so that the high-precision boosted voltage Vph can be achieved in both the case where the boosted voltage Vph is equal to ((N+1)×Vref+Vbase:N≧1) and the case where it is equal to (Vref+Vbase), and the width of the set voltage of the boosted voltage Vph can be increased.

(Fourth Embodiment)

Figure 17:
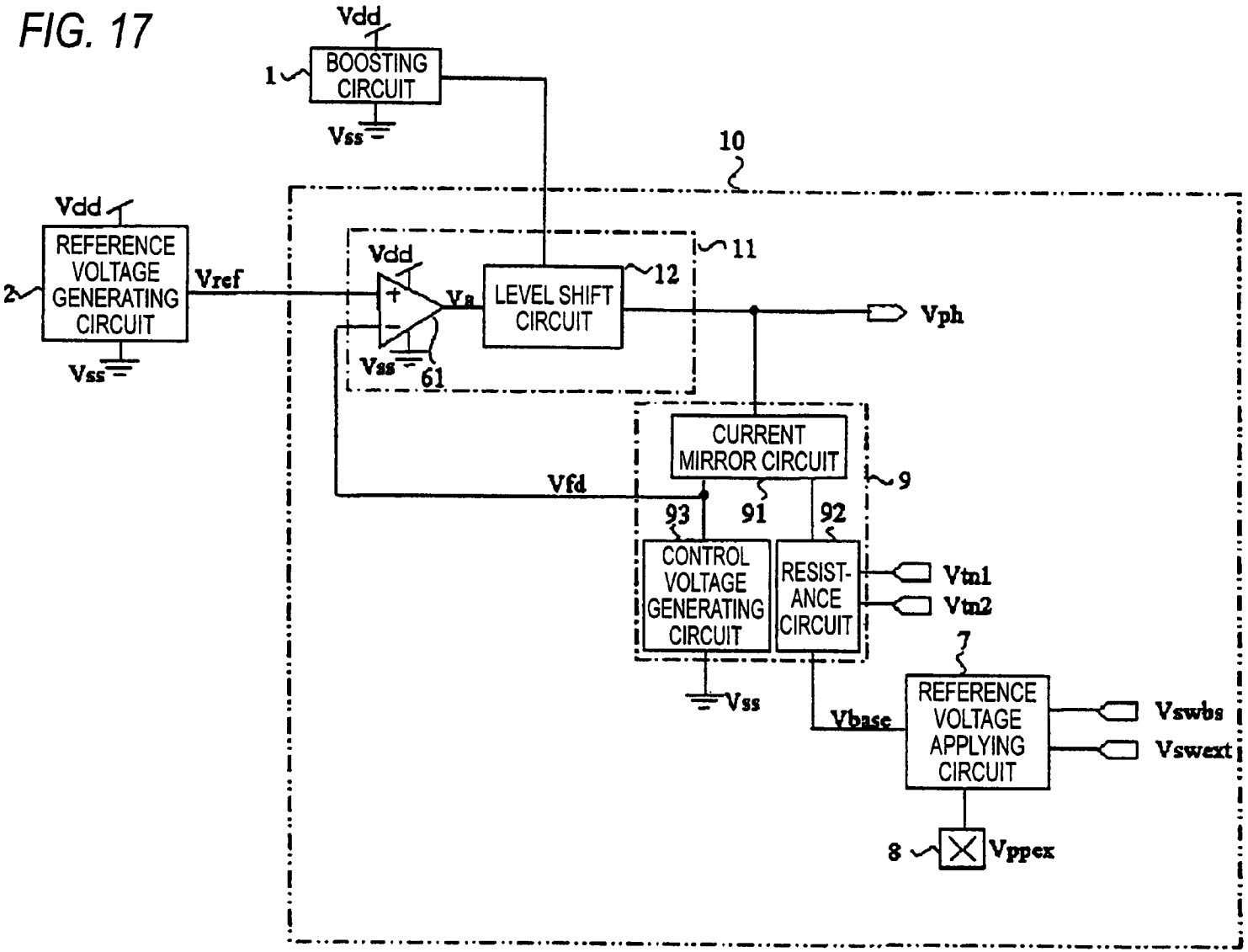
FIG. 17 shows a voltage generating circuit according to a fourth embodiment of the present invention.

The voltage generating circuit according to the fourth embodiment of the present invention will be described with reference to the drawings. FIG. 17 is a block diagram showing the construction of the voltage generating circuit according to the fourth embodiment.

In FIG. 17, the same reference numerals as FIG. 13 represent the same or corresponding parts.

The voltage generating circuit according to the fourth embodiment is equipped with a regulator 10 in which the clamp circuit 62 is replaced by a level shift circuit 12 in the voltage generating circuit according to the third embodiment.

In FIG. 17, 10 represents a regulator circuit, 11 represents a control circuit, and 12 represents a level shift circuit for level-shifting the boosted voltage Vph of the boosting circuit 1 in accordance with the output voltage Va of the differential amplifier circuit 61.

Figure 18:
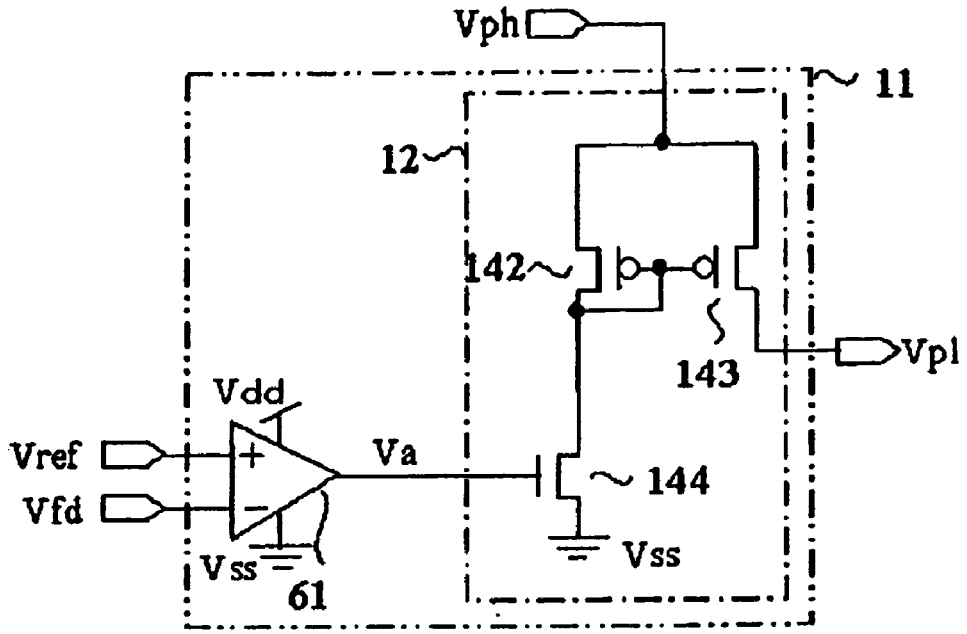
FIG. 18 shows a control circuit according to the fourth embodiment of the present invention.

FIG. 18 shows an example of the construction of the control circuit 11 according to the fourth embodiment. The control circuit 11 comprises the differential amplifier circuit 61 and the level-shift circuit 12, and 142 and 143 represent P-type MOS transistors constituting the current mirror circuit, and 144 represents an N-type MOS transistor whose drain current is determined in accordance with the output voltage Va of the differential amplifier circuit 61.

Next, the operation of the voltage generating circuit according to the fourth embodiment will be described. The operations of the circuits other than the control circuit 11 are the same as the third embodiment except that the driving based on the boosted voltage Vph of the voltage variation detecting circuit 9 is shifted to the driving based on the output voltage Vpl of the level shift circuit 12, and the description of the same operation portion is omitted.

As shown in FIG. 18, drain current flows in the N-type MOS transistor 144 by the output voltage Va of the differential amplifier circuit 61 which is driven with the power source voltage Vdd applied thereto, so that the gate voltage of the P-type MOS transistor 142 is adjusted and the drain current of the P-type MOS transistor 143 is varied, whereby the output voltage Vpl which his level-shifted from the boosted voltage Vph is set to a desired voltage. The output voltage Vpl thus level-shifted is set by ((N+1)×Vref+Vbase) when N represents the number of stages of the diode connection of the resistance circuit 92 in the voltage variation detecting circuit 9, and Vbase is any reference voltage. Another control circuit may be used as the controller 11 insofar as it carries out the same operation.

Figure 19:
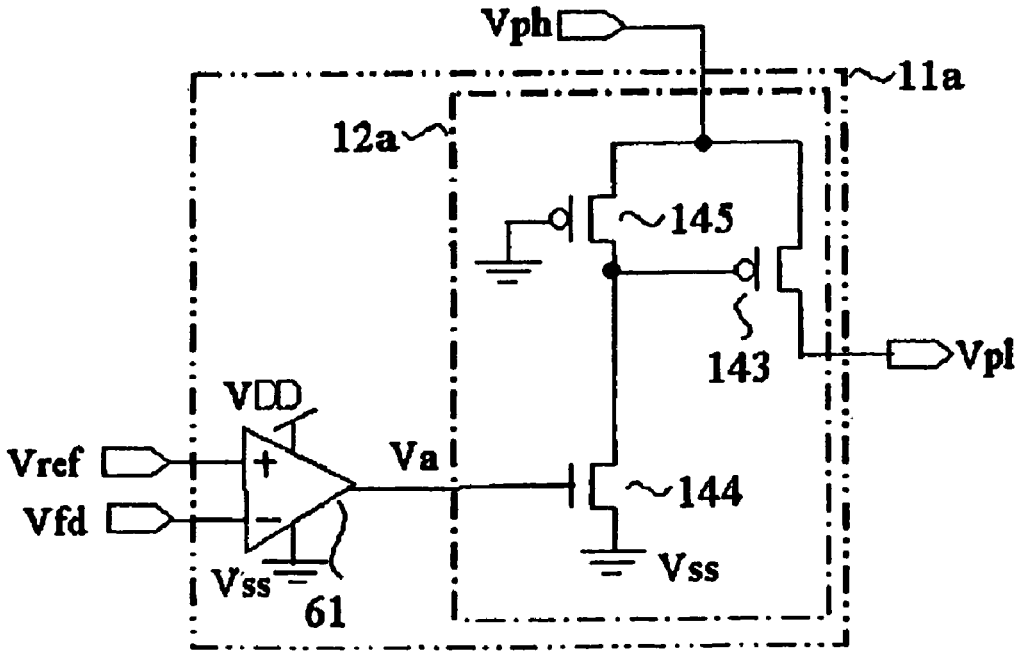
FIG. 19 shows another control circuit (part 1) of the fourth embodiment of the present invention.
Figure 20:
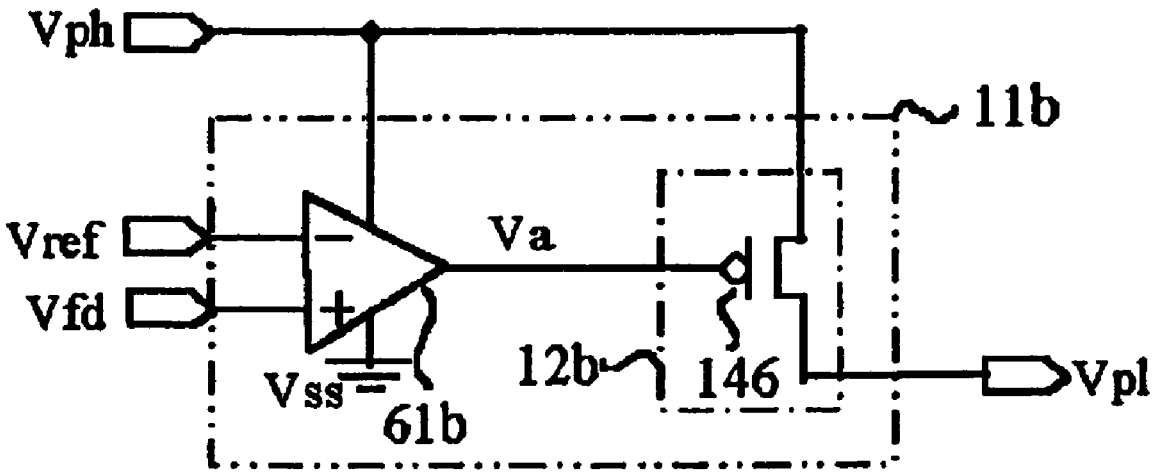
FIG. 20 shows another control circuit (part 2) of the fourth embodiment of the present invention.

FIGS. 19 and 20 show other examples of the control circuit.

FIG. 19 shows a control circuit 11*a* in which the P-type MOS transistor 142 shown in FIG. 18 is replaced by a P-type MOS transistor 145 having a gate connected to the ground, and it implements the same operation as the control circuit 11 of FIG. 18.

FIG. 20 shows a level shift circuit 12*b* in which the level shift circuit 12 of FIG. 18 is constructed by only a P-type MOS transistor 146. It is a control circuit 11*b* for adjusting the drain current in accordance with the output voltage Va of the differential amplifier circuit 61*b* driven with the boosted voltage Vp applied thereto, and outputting a desired voltage Vpl at the output of the level shift circuit 12*b*, and can implement the same operation as the control circuit 11 of FIG. 18.

Circuits having other constructions than the constructions shown in FIGS. 18, 19 and 20 may be used insofar as they can implement the same operation as the control circuit 11 of FIG. 18.

(Fifth Embodiment)

Figure 21:
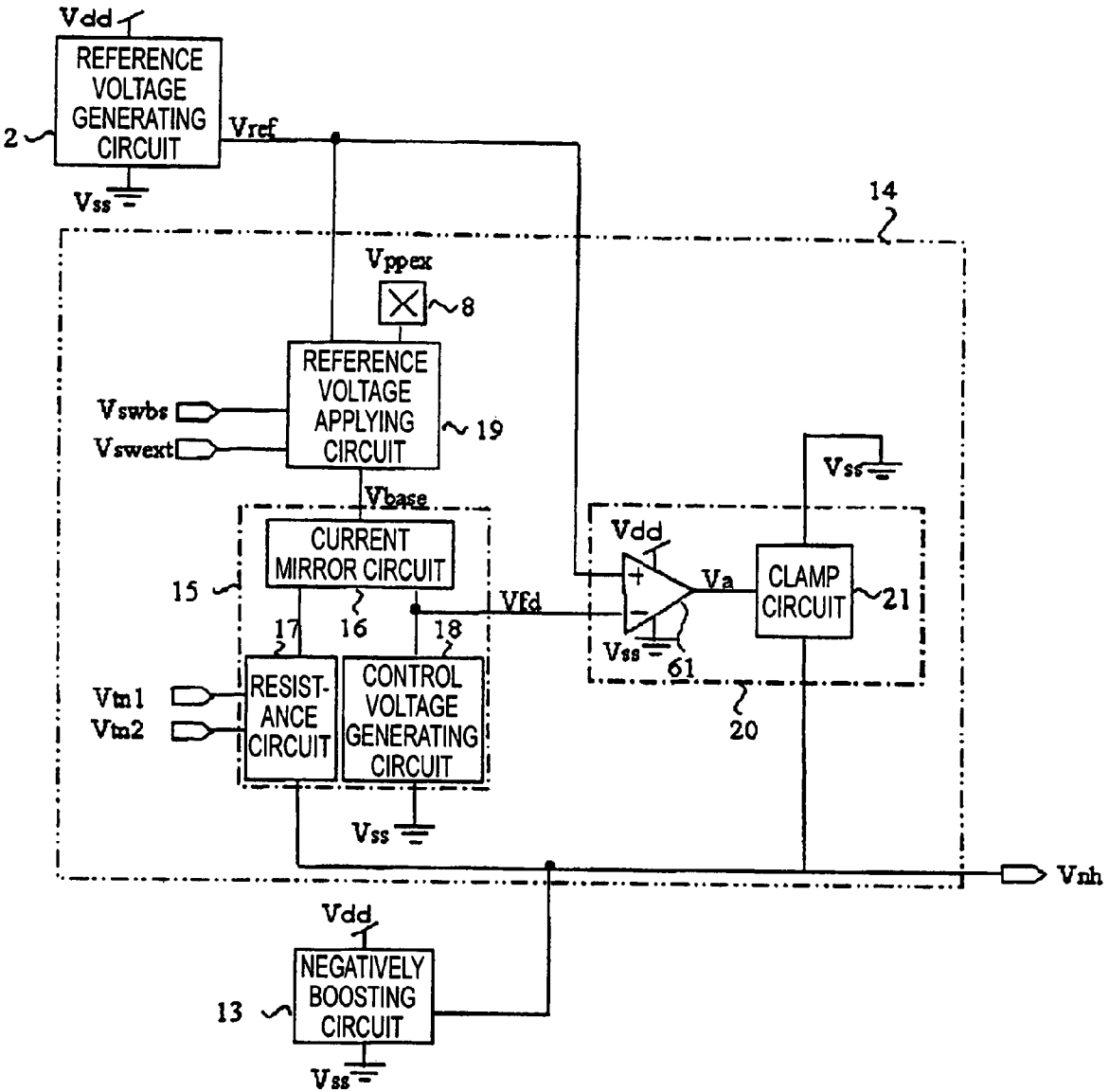
FIG. 21 shows a negative limiter circuit according to a fifth embodiment of the present invention.

A voltage generating circuit according to a fifth embodiment of the present invention will be described with the drawings. FIG. 21 is a block diagram showing the construction of the voltage generating circuit according to the fifth embodiment.

In FIG. 21, the same reference numerals as FIG. 13 represent the same or corresponding parts.

In FIG. 21, 13 represents a negatively boosting circuit that is driven with the power source voltage Vdd and generates a voltage lower than the ground voltage, 14 represents a negative limiter circuit, 15 represents a voltage variation detecting circuit, 16 represents a current mirror circuit, 17 represents a resistance circuit, 19 represents a reference voltage applying circuit, 20 represents a control circuit, and 21 represents a clamp circuit.

Next, the operation of the voltage generating circuit according to the fifth embodiment will be described. When a voltage lower than the ground voltage is generated by the negatively boosting circuit 13, the potential difference (Vbase−Vnh) occurs between the reference voltage Vbase and the negatively boosted voltage Vnh. The potential difference (Vbase−Vnh) is converted to current by the current mirror circuit 16 and the resistance circuit 17. The reference current corresponding to current flowing in the resistance circuit 17 is generated by the current mirror circuit 16, and then flows in the control voltage generating circuit 18 to generate the control voltage Vfd corresponding to the ground voltage reference. The reference voltage Vref generated in advance and the control voltage Vfd are compared with each other in the differential amplifier circuit 61 to control the clamp circuit 21 and set the negatively boosted voltage Vnh to a desired voltage.

Figure 22:
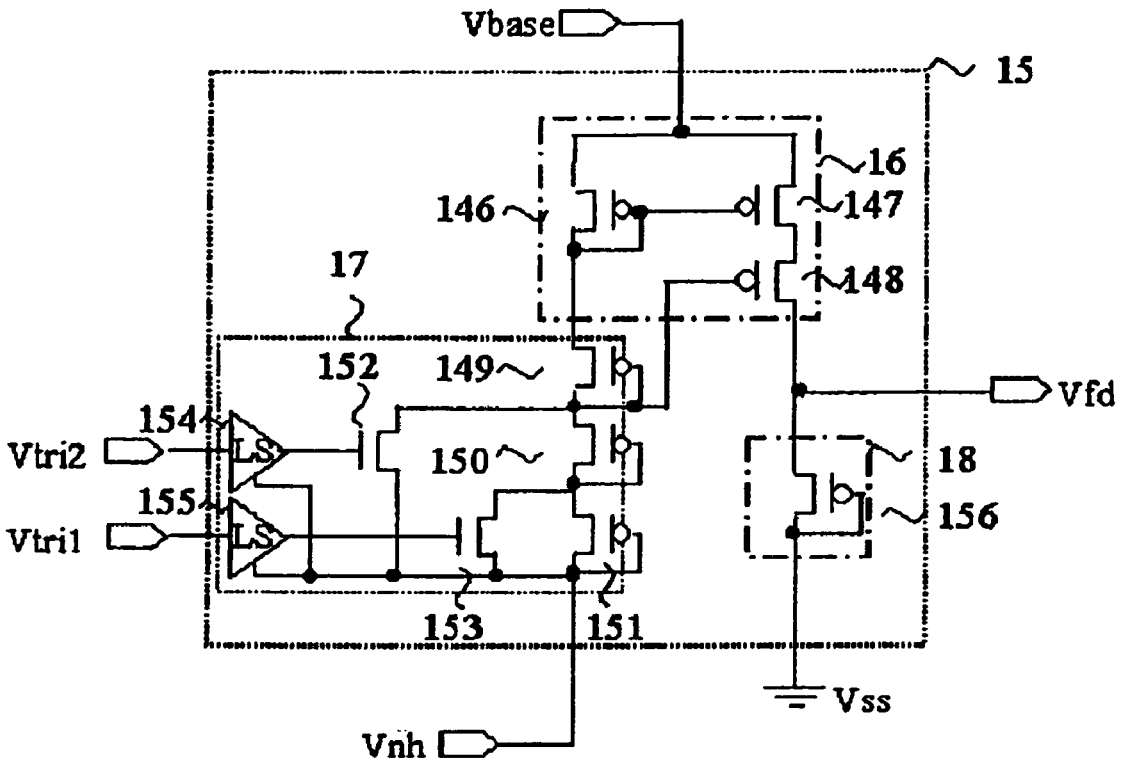
FIG. 22 shows a voltage variation detecting circuit according to a fifth embodiment of the present invention.

FIG. 22 is a circuit diagram showing an example of the construction of the voltage variation detecting circuit 15 of the voltage generating circuit according to the fifth embodiment. Each of 146, 147, 149, 150, 151, 156 is constructed by a P-type MOS transistor. It is assumed that the P-type MOS transistors 146, 147, 149, 150, 151, 156 have the same size.

In the voltage variation detecting circuit 15, 148 represents a P-type MOS transistor for suppressing variation of the drain voltage of the P-type MOS transistor 147, 152, 153 represents N-type MOS transistors 154, 155 for short-circuiting diode-connected P-type MOS transistors 150, 151 respectively, and 154, 155 represent level shift circuits for carrying out the switching operation between the power source voltage and the negative boosted voltage Vnh in accordance with the set voltage switching signal and outputting the switched one, respectively.

The potential difference (Vbase−Vnh) occurring between the reference voltage Vbase and the negatively boosted voltage Vnh is divided to the P-type MOS transistors 146, 149, 150, 151, and each divided voltage Vgs is equal to (Vbase−Vnh)/(four-stage diode connection). The current corresponding to Vgs is made to flow into the P-type MOS transistor 156 by the current mirror circuit 16 to thereby generate the control voltage Vfd (=Vgs) serving as the ground voltage reference.

The reference voltage Vref generated in advance and the control voltage Vfd are compared with each other in the differential amplifier circuit 61 to control the clamp circuit 21 and set the negatively boosted voltage Vnh to a desired voltage. With this setting, Vref is equal to Vfd. Therefore, Vref=((Vbase−Vnh)/(four-stage diode connection) is satisfied, and the negatively boosted voltage Vnh is set to the voltage of ((Vbase−four-stage diode connection)×Vref).

Accordingly, when P-type MOS transistors of N stages (N≧1) are connected to one another in series (diode-connection) in the resistance circuit 17, the negatively boosted voltage Vnh is set to (Vbase−(N+1)×Vref).

By setting the set voltage switching signals Vtri1 and Vtri2, the drain and source of the P-type MOS transistor 150 or 151 can be short-circuited to each other, and the voltage level of the negatively boosted voltage Vnh can be switched irrespective of any reference voltage Vbase.

Figure 23:
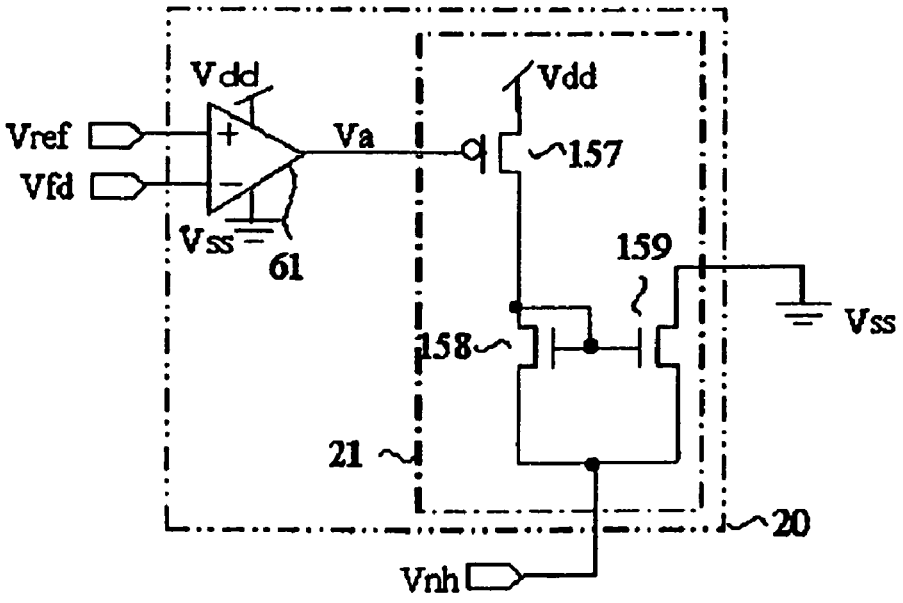
FIG. 23 shows a control circuit according to the fifth embodiment of the present invention.

FIG. 23 is a circuit diagram showing an example of the construction of the control circuit 20 of the voltage generating circuit according to the fifth embodiment.

In FIG. 23, 157 represents a P-type MOS transistor in which the drain current corresponding to the output voltage Va of the differential amplifier circuit 61 flows, 158 represents an N-type MOS transistor for generating Vgs corresponding to the drain current of the P-type MOS transistor 157, and 159 represents an N-type MOS transistor acting to extract the negatively boosted voltage Vnh to the ground voltage when Vgs of the N-type MOS transistor 158 is applied to the N-type MOS transistor 159.

The reference voltage generated in advance and the control voltage Vfd are compared with each other in the differential amplifier circuit 61 driven with the power source voltage, and the drain current corresponding to the output voltage Va of the differential amplifier circuit 61 flows in the P-type MOS transistor 157, so that the current amount extracted from the negatively boosted voltage Vnh to the ground voltage is adjusted by the N-type MOS transistor 159 and the negatively boosted voltage Vnh is set to a desired voltage.

Another control circuit may be used as the control circuit of the fifth embodiment insofar as it can implement the same operation.

Figure 24:
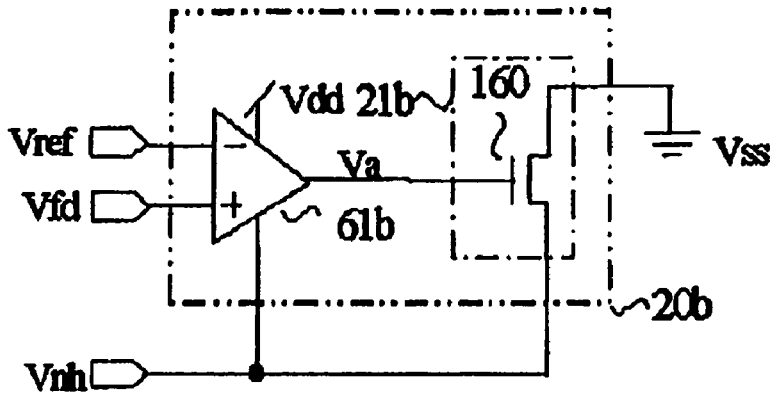
FIG. 24 shows another control circuit according to the fifth embodiment of the present invention.
Figure 25:
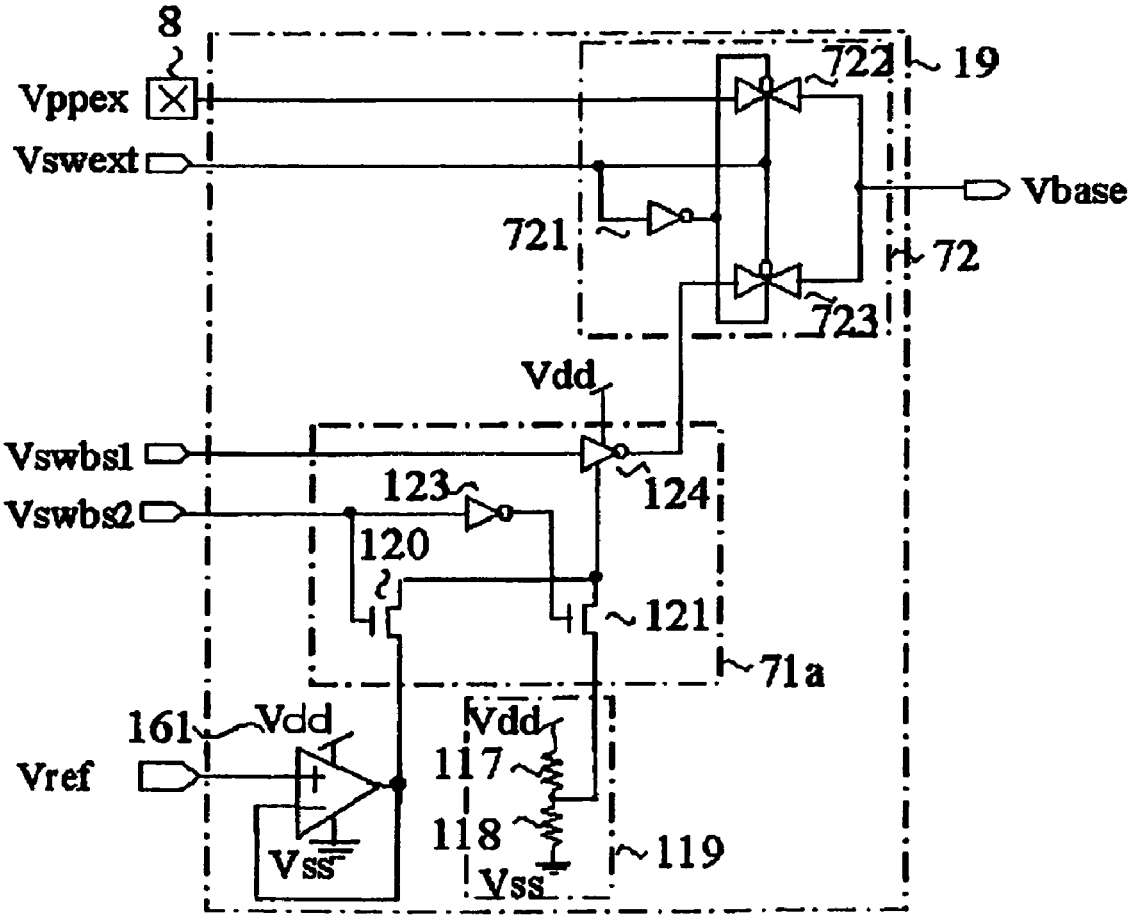
FIG. 25 shows a reference voltage applying circuit according to the fifth embodiment of the present invention.

FIG. 24 shows another example of the control circuit. The control circuit shown in FIG. 24 is constructed so that the differential amplifier circuit 61 which is driven by applying the power source voltage thereto is replaced by a differential amplifier circuit 61*b* which is supplied with the power source voltage Vdd and the negatively boosted voltage Vnh and compares the control voltage Vfd and the reference voltage Vref, and the clamp circuit 21 is replaced by a clamp circuit 21*b* comprising an N-type MOS transistor 160. With this construction, the same negatively boosted voltage Vnh as FIG. 23 can be achieved. Furthermore, FIG. 25 shows the reference voltage applying circuit 19 of the fifth embodiment.

In FIG. 19, reference voltage switching signals Vswbs1, Vswbs2 are switched to control the N-type MOS transistors 120, 121 and the inverter circuits 123 and 124, thereby switching the reference voltage generated as the reference voltage Vbase by the power source voltage Vdd, the reference voltage Vref and the voltage dividing circuit 119 comprising the resistor 117 and the resistor 118. The reference voltage Vref is output under low impedance stage, so that it is applied through a voltage follower circuit 161.

The inverter circuit 721 for controlling the transfer gate circuits 722 and 723 is controlled by the external applied voltage switching signal to carry out the switching operation between the reference voltage and the external applied voltage Vppex, so that the negatively boosted voltage Vnh having plural voltage-dependence characteristics can be achieved.

Another reference voltage that can perform the same operation may be used as the reference voltage Vbase.

As described above, the voltage generating circuit according to the fifth embodiment is equipped with the voltage variation detecting circuit 15 having the current mirror circuit 146, the resistance circuit 17 and the control voltage generating circuit 18, and thus high-precision negatively boosted voltage Vnh (=Vbase−(N+1)×Vref:N≧1) dependent on any reference voltage Vbase can be achieved.

Furthermore, current pulses which assume the negatively boosted voltage Vnh stationarily can be reduced by the voltage variation detecting circuit, so that the current consumption of the negatively boosted voltage Vnh can be reduced.

(Sixth Embodiment)

Figure 26:
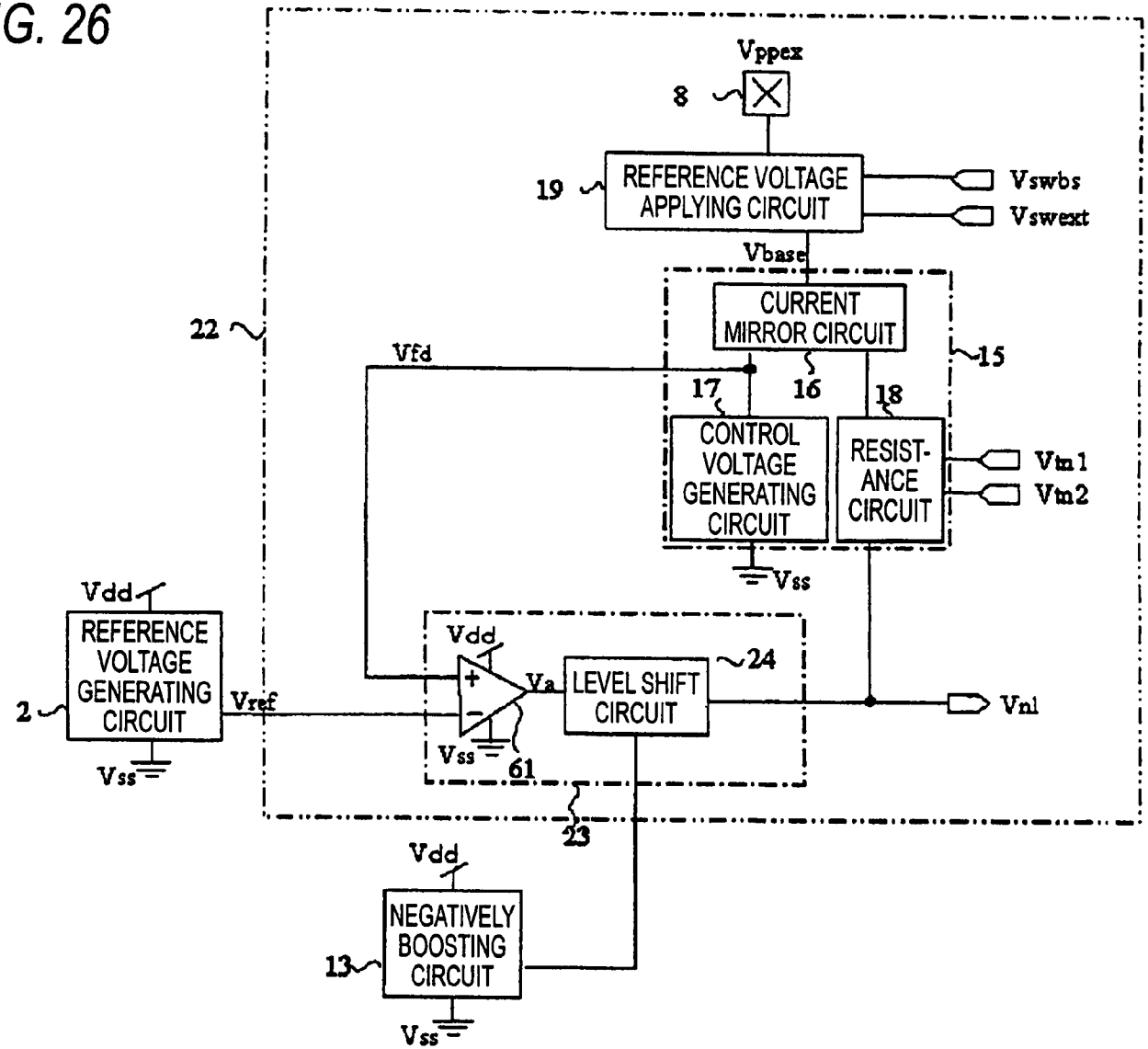
FIG. 26 shows a negative regulator circuit according to a sixth embodiment of the present invention.

The voltage generating circuit according to the sixth embodiment of the present invention will be described with reference to the drawings. FIG. 26 is a block diagram showing the construction of the voltage generating circuit according to the sixth embodiment.

In FIG. 26, the same reference numerals as FIG. 21 represent the same or corresponding parts.

The voltage generating circuit according to the sixth embodiment is a voltage generating circuit having a negative regulator in which the clamp circuit 21 is replaced by a level shift circuit 24 in the voltage generating circuit according to the fifth embodiment described above.

In FIG. 26, 22 represents a negative regulator circuit, 23 represents a control circuit, and 24 represents level-shifting the negatively boosted voltage Vnh of the negatively boosting circuit 13 in accordance with the output voltage Va of the differential amplifier circuit 61 and outputting the output voltage Vnh.

Figure 27:
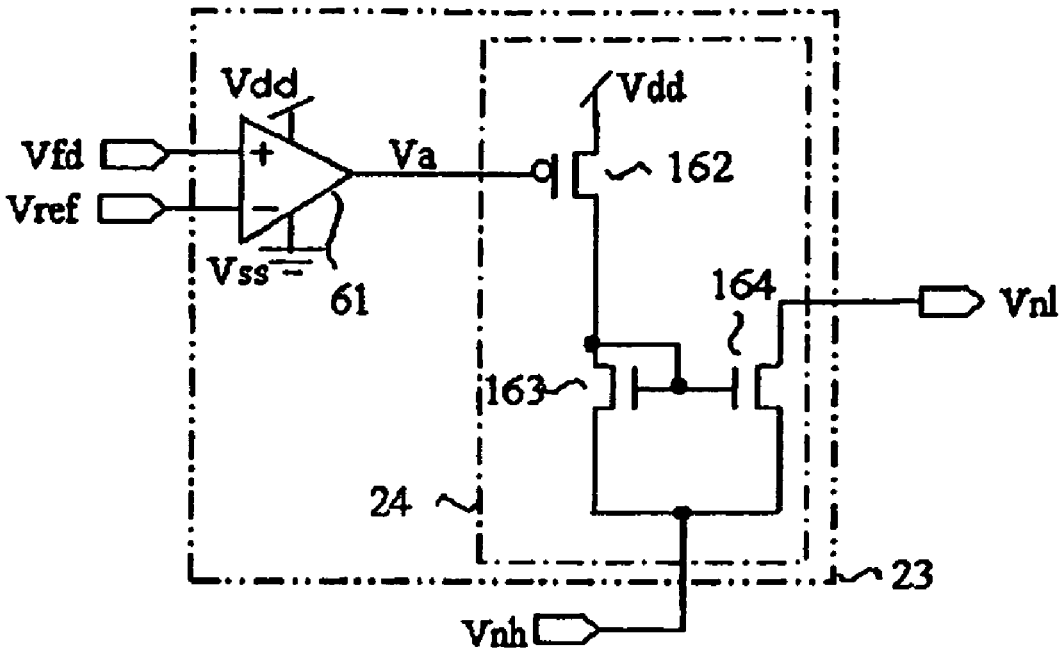
FIG. 27 shows a control circuit according to the sixth embodiment of the present invention.

FIG. 27 shows an example of the construction of the control circuit 23 of the sixth embodiment of the present invention. The control circuit 23 comprises a differential amplifier circuit 61 and a level shift circuit 24. 162 represents a P-type MOS transistor which is controlled by the output voltage Va of the differential amplifier circuit to determine the drain current, 163 represents an N-type MOS transistor for generating Vgs with the drain current of the P-type MOS transistor 162, and 164 adjusts the drain current when supplied with the gate voltage of the N-type MOS transistor 163, and sets the output voltage Vn1 of the level shift circuit to a desired voltage level.

Next, the operation of the voltage generating circuit according to the sixth embodiment will be described.

The operation associated with the construction other than the control circuit 23 is the same as the fifth embodiment except that the driving based on the negatively boosted voltage Vnh of the voltage variation detecting circuit 15 is shifted to the driving based on the output voltage Vn1 of the level shift circuit, and the same operation part is omitted from the following description.

As shown in FIG. 27, the drain current of the P-type MOS transistor 162 is made to flow by the output voltage Va of the differential amplifier circuit 61 which is driven by applying the power source voltage Vdd and the ground voltage Vss thereto, whereby the gate voltage of the N-type MOS transistor 163 is adjusted, the drain current of the N-type MOS transistor 164 is varied and the output voltage Vn1 level-shifted from the negatively boosted voltage Vnh is set to a desired voltage.

The output voltage Vn1 thus level-shifted is set to (=Vbase−(N+1)×Vref:N≧1) when the number of diode-connection stages of a resistance circuit 17 of the voltage variation detecting circuit 15 is equal to N. Vbase represents any reference voltage.

In FIG. 27, an example using the control circuit 23 is described. However, another control circuit may be used insofar as the same operation can be performed.

Figure 28:
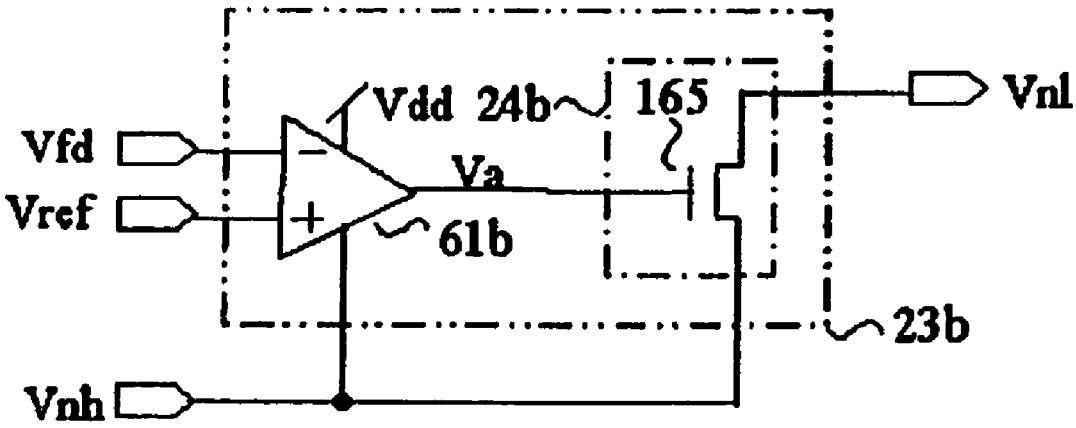
FIG. 28 shows another control circuit according to the sixth embodiment of the present invention.

FIG. 28 shows another example of the control circuit. FIG. 28 shows a control circuit 23*b* for adjusting the drain current of the N-type MOS transistor by the output voltage Va of the differential amplifier circuit 61*b* which is driven by applying the negatively boosted voltage Vnh thereto in FIG. 27, and outputting a desired voltage Vn1 at the output of the level shift circuit 24*b*. The control circuit 23*b* can implement the same operation as the control circuit 23 of FIG. 27.

The circuit construction is not limited to the above construction insofar as the same operation as the control circuit 23 of FIG. 27 can be implemented.

(Seventh Embodiment)

The voltage generating circuit according to a seventh embodiment according to the present invention will be described with reference to the drawings.

Figure 29:
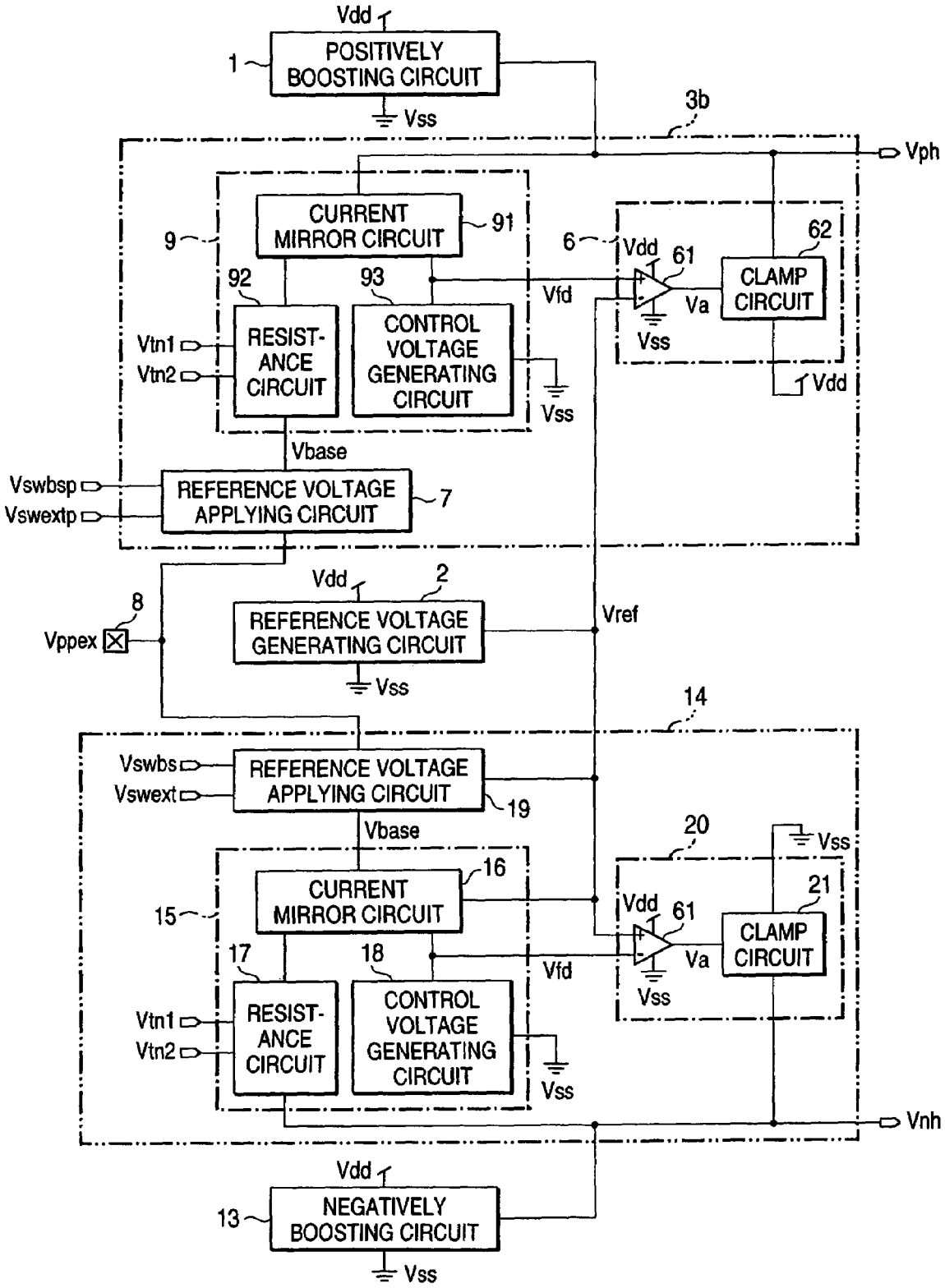
FIG. 29 is a block diagram showing the construction of a voltage generating circuit according to a seventh embodiment.

FIG. 29 is a block diagram showing the construction of the voltage generating circuit according to the seventh embodiment. In FIG. 29, 1 represents a boosting circuit for generating a voltage which is not less than the power source voltage, 2 represents a reference voltage generating circuit for generating a reference voltage form the power source voltage, 3*b* represents a limiter circuit, 6 represents a control circuit, 61 represents a differential amplifier circuit for comparing the control voltage and the reference voltage, 62 represents a clamp circuit for setting the boosted voltage Vph to a desired voltage on the basis of the output voltage of he differential amplifier circuit, 7 represents a reference voltage applying circuit, 8 represents a pad for applying an external voltage, 9 represents a voltage variation detecting circuit, 91 represents a current mirror circuit, 92 represents a resistance circuit, 93 represents a control voltage generating circuit, 13 represents a negatively boosting circuit for generating a voltage lower than the ground voltage, 15 represents a voltage variation detecting circuit, 16 represents a current mirror circuit, 17 represents a resistance circuit, 18 represents a control voltage generating circuit, 19 represents a reference voltage generating circuit, 20 represents a control circuit and 21 represents a clamp circuit.

The same parts as FIGS. 13 and 21 represent the same or corresponding parts, and the description thereof is omitted.

Next, the operation of the voltage generating circuit according to the seventh embodiment of the present invention will be described. A reference voltage Vref is generated in advance by the reference voltage circuit 2, and the limiter circuit 3*b* and the negative limiter circuit 14 generate the boosted voltage Vph, the negatively boosted voltage Vnh dependent on any reference voltage Vbase such as the power source voltage Vdd, the external applied voltage Vppex or the like on the basis of the reference voltage Vref. The driving operation of the voltage generating circuit other than described above is the same as the fifth embodiment, and the description thereof is omitted.

As described above, according to the voltage generating circuit of the seventh embodiment of the present invention, the circuits having the same effect as the third embodiment and the fifth embodiment may be equipped on one substrate, and these circuits can be operated with the reference voltage Vref, so that the limiter circuit and the negative limiter circuit can be driven by one reference voltage generating circuit, and the circuit area can be reduced as compared with the case where the reference voltage generating circuits are separately equipped.

When a voltage dependent on an external applied voltage is needed, the boosted voltage Vph and the negatively boosted voltage Vnh which are dependent on the external applied voltage Vppex can be generated by applying the external applied voltage Vppex corresponding to the power source voltage to both the limiter circuit and the negative limiter circuit. Therefore, the negative pad can be eliminated, and the area of the voltage generating circuit can be reduced.

(Eighth Embodiment)

Figure 30:
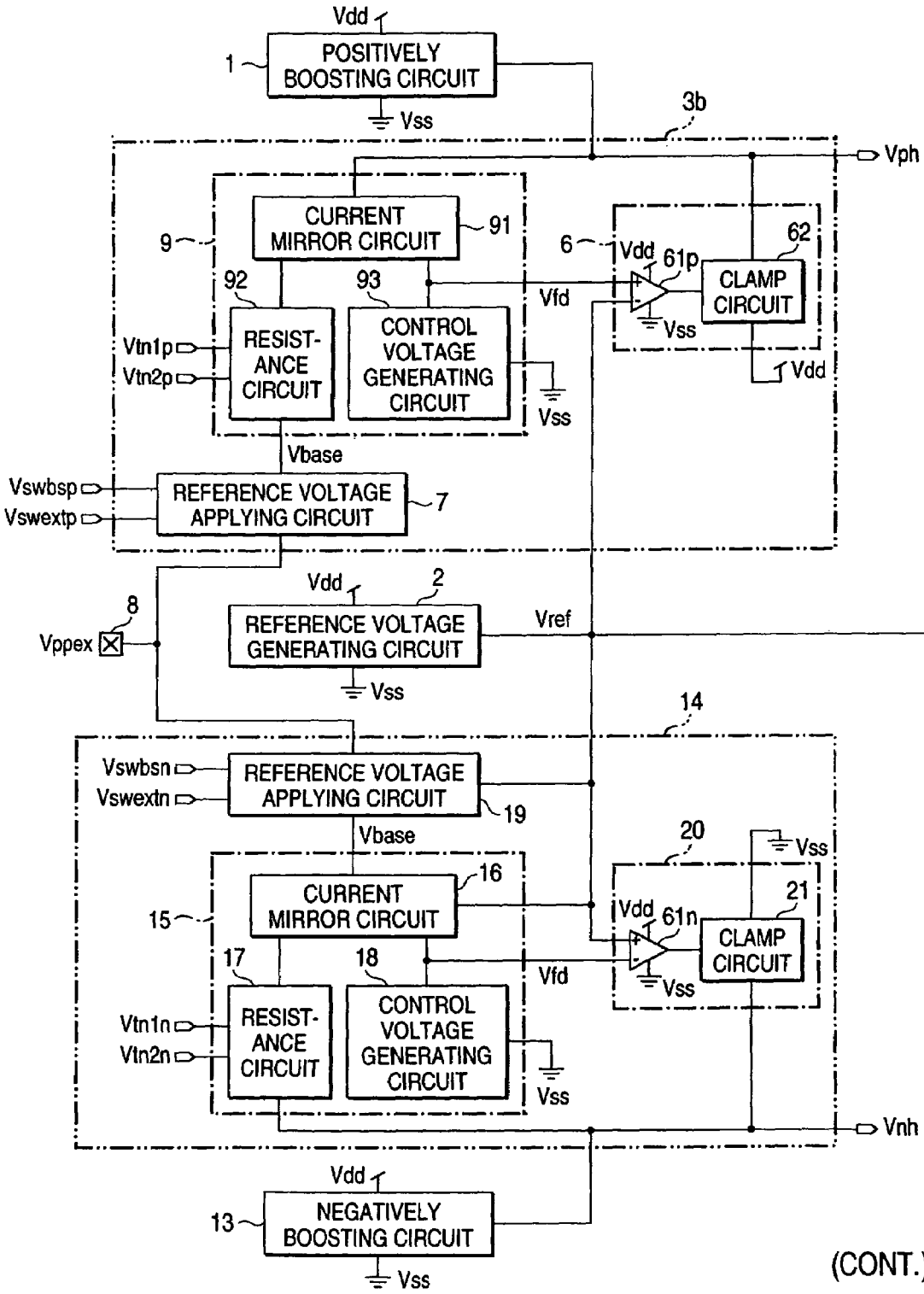
FIG. 30 is a block diagram showing the construction of a voltage generating circuit according to an eighth embodiment.
Figure 31:
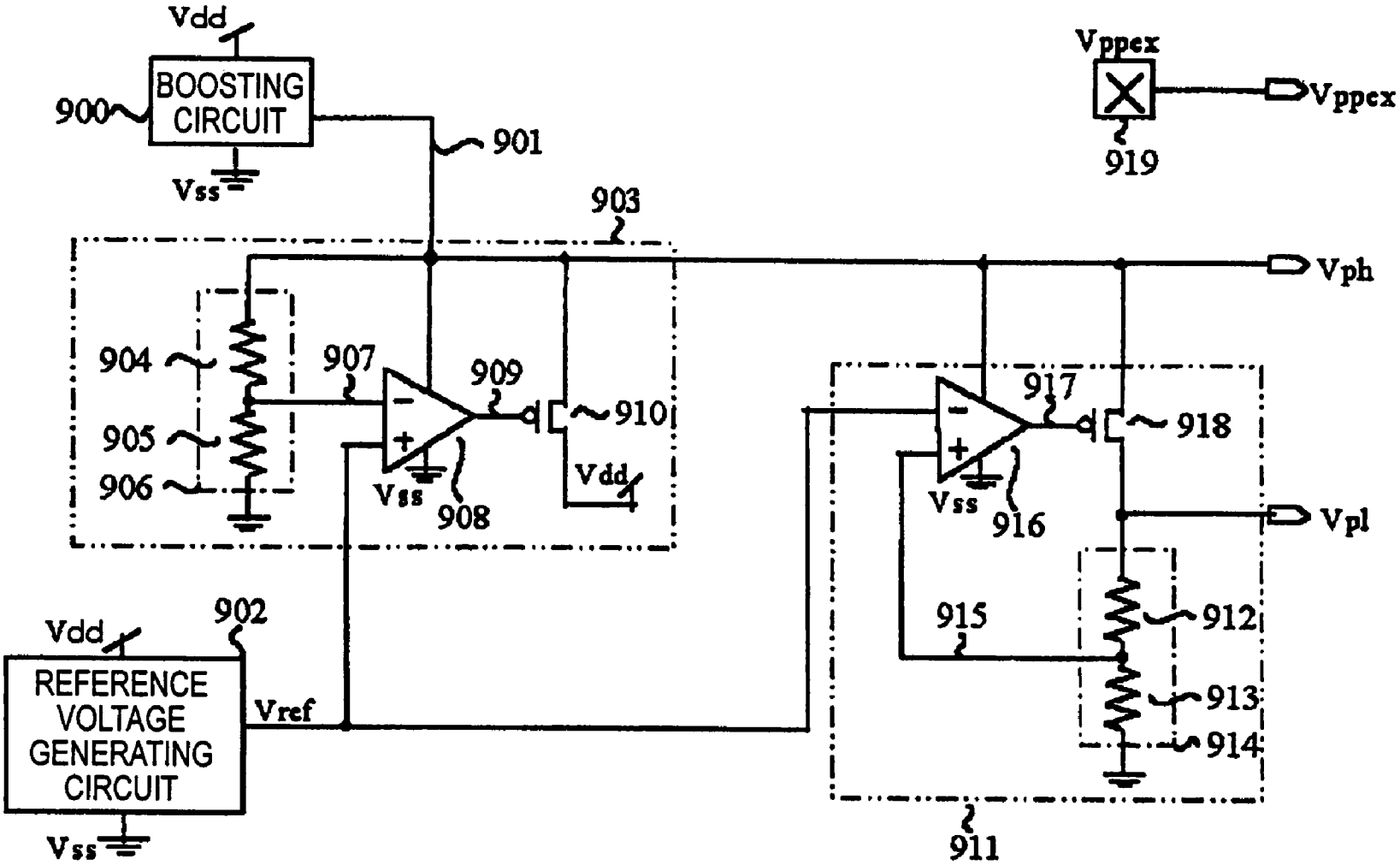
FIG. 31 is a block diagram showing the construction of a conventional voltage generating circuit.
Figure 32:
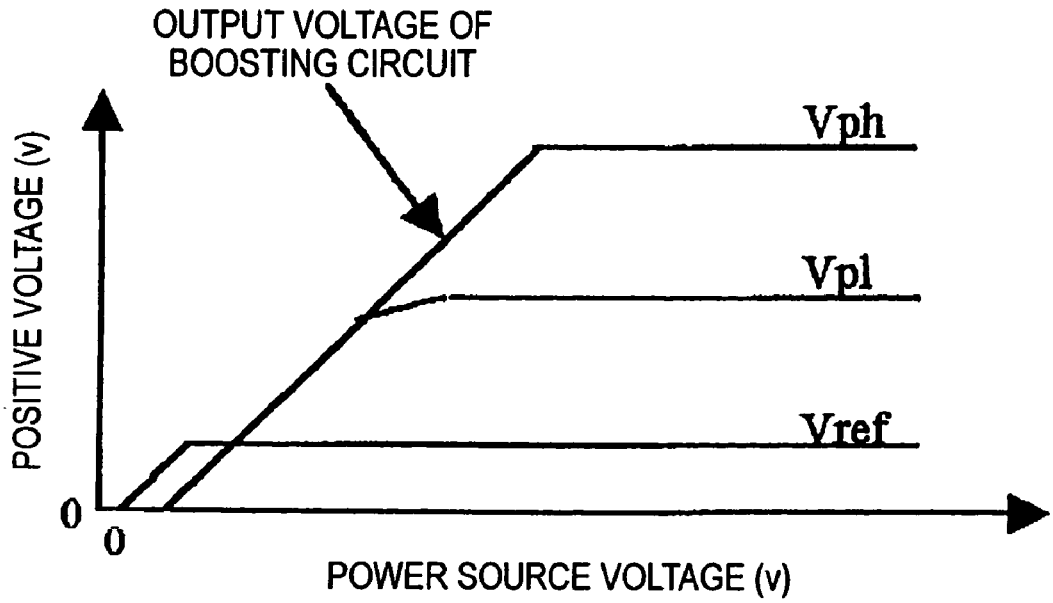
FIG. 32 is a graph showing the power source voltage characteristic of a boosted voltage Vph, a reference voltage Vref and a level-shifted voltage Vpl of the conventional voltage generating circuit.
Figure 33:
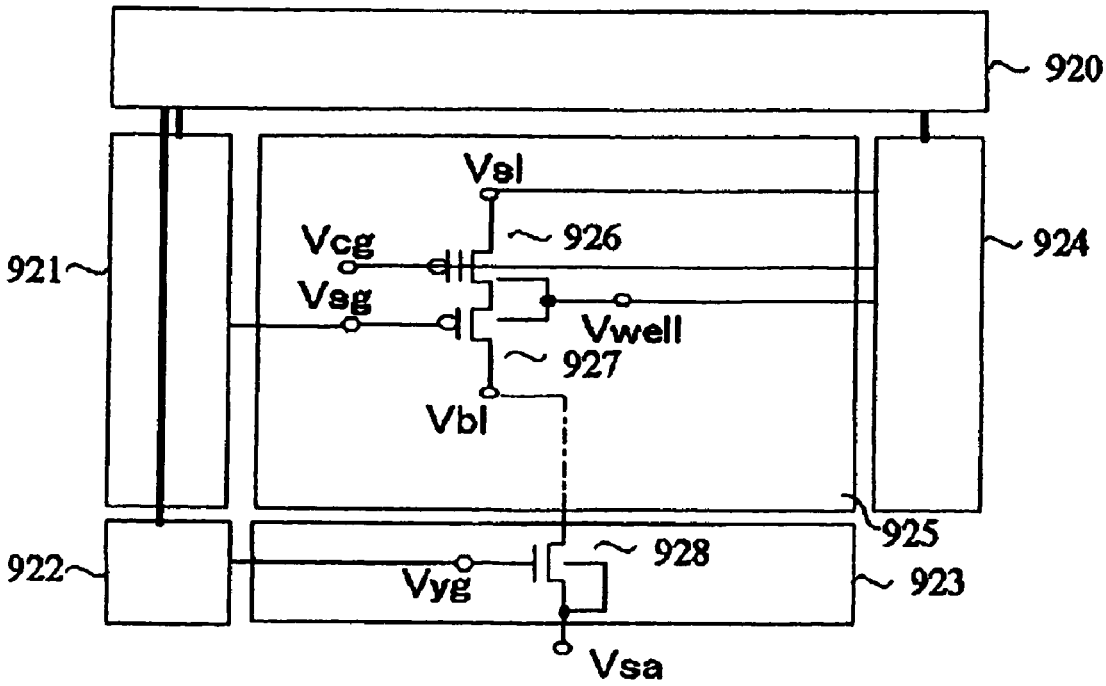
FIG. 33 is a circuit diagram showing the construction of a flash memory cell.

The voltage generating circuit according to an eighth embodiment of the present invention will be described with reference to the drawings. FIG. 30 is a block diagram showing the construction of the voltage generating circuit according to the eighth embodiment.

In FIG. 30, 1 represents a boosting circuit for generating a voltage which is not less than the power source voltage, 2 represents a reference voltage generating circuit for generating a reference voltage from the power source voltage, 3*b* represents a limiter circuit, 6 represents a control circuit, 61 represents a differential amplifier circuit for comparing a control voltage and a reference voltage, 62 represents a clamp circuit for setting a boosted voltage Vph to a desired voltage on the basis of the output voltage of the differential amplifier circuit, 7 represents a reference voltage applying circuit, 8 represents a pad for applying an external voltage, 9 represents a voltage variation detecting circuit, 91 represents a current mirror circuit, 92 represents a resistance circuit, 93 represents a control voltage generating circuit, 13 represents a negatively boosting circuit for generating a voltage lower than the ground voltage, 15 represents a voltage variation detecting circuit, 16 represents a current mirror circuit, 17 represents a resistance circuit, 18 represents a control voltage generating circuit, 19 represents a reference voltage generating circuit, 20 represents a control circuit, 21 represents a clamp circuit, 15*a* represents a voltage variation detecting circuit, 16*a* represents a current mirror circuit, 17*a* represents a resistance circuit, 18*a* represents a control voltage generating circuit, 19*a* represents a reference voltage generating circuit, 61*d* represents a differential amplifier circuit, 25 represents a voltage output regulator circuit for the voltage output between the power source voltage and the ground voltage, 21 represents a clamp circuit, and 26 represents a level shift circuit.

The same reference numerals as FIGS. 13 and 21 represent the same or corresponding parts, and the description thereof is omitted.

Next, the operation of the voltage generating circuit according to the eighth embodiment of the present invention will be described.

The voltage output regulator circuit 25 for the voltage output between the power source voltage and the ground is constructed so that the input voltage of the level shift circuit 24 of the negative regulator circuit 22 of FIG. 26 is changed from the output voltage Vnh of the negatively boosting circuit to the ground voltage, and it is a circuit that can output the voltage between the power source and the ground which is dependent on the reference voltage Vbase switched by the reference voltage applying circuit. The detailed description of the operation thereof is omitted.

The reference voltage Vref is generated in advance by the reference voltage circuit 2, and the limiter circuit 3*b*, the negative limiter circuit 14 and the regulator circuit 25 generate the boosted voltage Vph, the negatively boosted voltage Vnh dependent on any reference voltage Vbase such as the power source voltage Vdd, the external applied voltage Vppex or the like on the basis of the reference voltage Vref. The driving operation of the voltage generating circuit other than described above is the same as the third embodiment and the fifth embodiment, and the description thereof is omitted.

As described above, according to the voltage generating circuit of the eighth embodiment, all the boosted voltage, the negatively boosted voltage dependent on any reference voltage Vbase and the voltage between the power source voltage and the ground voltage can be generated by one reference voltage generating circuit, and the circuit area can be reduced as compared with the case where reference voltage generating circuits are separately equipped.

As described in detail, according to the present invention, the voltage variation detecting circuit having the current mirror circuit, the resistance circuit and the control voltage generating circuit is equipped as the constituent elements of the limiter circuit and the regulator circuit to generate the control voltage Vfd from the boosted voltage Vph and compare the control voltage Vfd with the reference voltage Vref, so that the high-precision positively boosted voltage Vph dependent on the power source voltage Vdd can be achieved.

Furthermore, the differential amplifier circuit driven with the power source voltage Vdd is equipped as the constituent elements of the limiter circuit and the regulator circuit. Therefore, the current to be assumed by the boosted voltage Vph can be reduced, and thus waste consumption of the power source voltage Vdd by the boosted circuit can be reduced.

In the voltage variation detecting circuit as the constituent element of the limiter circuit and the regulator circuit, the variation of the drain voltage of the P-type MOS transistor for carrying out current reference can be suppressed by applying any terminal voltage of the resistance circuit to the gate of the P-type MOS transistor connected in series to the P-type MOS transistor for carrying out the current reference of the current mirror, thereby making it possible to achieve the high-precision boosted voltage Vph which is not dependent on the voltage level of the boosted voltage Vph and is based on the power source voltage Vdd.

The gate voltage of the P-type MOS transistor which is used in the current mirror circuit of the voltage variation detecting circuit to suppress the variation of the drain voltage is switched between the case where the boosted voltage Vph set by the set voltage switching signal is equal to ((N+1)×Vref+Vbase:N≧1 ) and the case where the boosted voltage Vph is equal to (Verf+Vbase), so that the high-precision boosted voltage Vph can be achieved in both the cases where the boosted voltage Vph is equal to ((N+1)×Vref+Vbase:N≧1) and the case where the boosted voltage Vph is equal to (Verf+Vbase), and the width of the set voltage of the boosted voltage Vph can be increased.

Furthermore, the voltage-dependence of the boosted voltage Vph can be arbitrarily switched to the power source voltage dependence ((N+1)×Vref+Vdd:N≧1), the ground voltage dependence ((N+1)×Vref+Vss:N≧1) or the like by the reference voltage switching signal Vswbs.

Accordingly, when the voltage-dependence of the boosted voltage Vph for optimizing the circuit characteristic is varied in accordance with the operation mode such as the data deletion, data writing, data reading or the like and the circuit like a non-volatile semiconductor storage device, the voltage-dependence of the boosted voltage Vph can be switched and supplied as occasion demands, so that the circuit characteristic can be enhanced.

Furthermore, the boosted voltage Vph having plural voltage-dependence characteristics can be supplied to the circuits while switched by the same circuit. Therefore, the circuit area can be reduced.

Still furthermore, the voltage ((N+1)×Vref+Vppex:N≧1) which is dependent on the external applied voltage and higher than the external applied voltage Vppex can be generated as the boosted voltage Vph by the external voltage applying signal Vswext.

Accordingly, even when the external voltage corresponding to the boosted voltage is needed to estimate the characteristic of the memory cell in the non-volatile semiconductor storage device or the like, it is sufficient to apply the voltage corresponding to the power source voltage from the pad. Therefore, surge breaking occurring in the pad and the device under application of a high voltage can be prevented.

Furthermore, when the boosted voltage is output while switching plural voltage dependence characteristics, the voltage level of the boosted voltage Vph having each voltage dependence characteristic can be set by using the same circuit at the switching time of the voltage level of the boosted voltage having each voltage dependence characteristic. Therefore, the circuit area can be reduced.

Still furthermore, in the negative limiter circuit and the negative regulator circuit, the high-precision negatively boosted voltage Vnh dependent on any reference voltage Vbase (=Vbase−(N+1)×Vref:N≧1) can be achieved by providing the voltage variation detecting circuit having the current mirror circuit, the resistance circuit and the control voltage generating circuit.

Still furthermore, in the negative limiter circuit and the negative regulator circuit, the current path in which the negatively boosted voltage Vnh is stationarily consumed is reduced by the voltage variation detecting circuit, so that the current consumption of the negatively boosted voltage Vnh can be reduced.

Still furthermore, the limiter circuit and the negative limiter circuit can be equipped on one substrate, and also both the circuits can be operated with the reference voltage Vref, so that the limiter circuit and the negative limiter circuit can be operated by one reference voltage generating circuit, and also the circuit area can be reduced as compared with the case where the reference voltage generating circuits are separately equipped.

In the case where the limiter circuit and the negative limiter circuit are equipped on one substrate, the boosted voltage Vph and the negatively boosted voltage Vnh which are dependent on the external applied voltage Vppex can be generated by applying the external applied voltage Vppex corresponding to the power source voltage to both the limiter circuit and the negative limiter circuit when a voltage dependent on the external applied voltage is needed. Therefore, the area of the voltage generating circuit can be reduced.

Furthermore, in the regulator circuit for generating the voltage between the power source voltage and the ground voltage while reducing the voltage, the high-precision dropped voltage Vdm (=Vbase−(N+1)×Vref:N≧1) dependent on any reference voltage Vbase can be achieved by providing the voltage variation detecting circuit having the current mirror circuit, the resistance circuit and the control voltage generating circuit.

In the limiter circuit that has the voltage variation detecting circuit equipped with the current mirror circuit, the resistance circuit and the control voltage generating circuit and generates the boosted voltage, the negatively boosting circuit for generating the negatively boosted voltage, and the regulator circuit for generating the voltage between the power source voltage and the ground, all the voltages of the boosted voltage and negatively boosted voltage dependent on any reference voltage Vbase and the dropped voltage between the power source and the ground can be generated by one reference voltage, and the circuit area can be reduced as compared with the case where the reference voltage generating circuits are separately equipped.

What is claimed is:

1. A voltage generating circuit having a boosting circuit for generating a voltage higher than a power source voltage and a reference voltage generating circuit for generating a reference voltage, a desired voltage being generated on the basis of the reference voltage, comprising:

a level shift circuit for receiving an output voltage of the boosting circuit to level-shift the voltage and outputting the desired voltage thus level-shifted;

a voltage variation detecting circuit having a first input connected to the output of the level shift circuit, a second input connected to the power source and a third input connected to the ground, reference current equivalent to current occurring due to the potential difference between the first input and the second input being made to flow into the third input to generate a control voltage at a first output; and a differential amplifier circuit for comparing the control voltage and the reference voltage to control the level shift circuit, and outputting the desired voltage as the output of the level shift circuit.

2. The voltage generating circuit according to claim 1, further comprising:

first switching means for receiving a set voltage switching signal, carrying out a switching operation between the first input and the ground voltage and outputting the switched one; and second switching means connected between the first input and the second input for switching the potential difference between the first input and the second input in accordance with the output voltage of the first switching means.

3. The voltage generating circuit according to claim 1, wherein the voltage variation detecting circuit comprises:

a reference current being generated by a voltage applied to a fourth input so as to keep a constant current ratio to current occurring due to the potential difference between the first input and the second input, and the reference current being made to flow into the third input to generate a control voltage at a first output;

wherein the voltage generating circuit further comprises:

first switching means for receiving a set voltage switching signal, carrying out a switching operation between the first input and the ground voltage and outputting the switched one;

second switching means connected between the first input and the second input for switching the potential difference between the first input and the second input in accordance with the output voltage of the first switching means; and third switching means connected to the output of the first switching means for switching to any voltage between the first input and the second input or the ground voltage and applying the switched voltage to the fourth input.

4. The voltage generating circuit according to claim 1, wherein the level shift has a first conduction type transistor having a source connected to the output of the boosting circuit, a gate connected to the output of the differential amplifier circuit and a drain connected to the output of the level shift circuit, and the differential amplifier circuit is supplied with an output voltage of the boosting circuit, comparing the control voltage and the reference voltage and carrying out differential amplification on the basis of the output voltage of the boosting circuit.

5. The voltage generating circuit according to claim 1, wherein the level shift circuit comprises:

a first conduction type first transistor having a source connected to the output of the boosting circuit and a gate and a drain that are connected to a first terminal; and a first conduction type second transistor having a source connected to the output of the boosting circuit, a gate connected to the first terminal and a drain connected to the output of the level shift circuit; and a second conduction type transistor connected to the first terminal and ground having a gate connected to the output of the differential amplifier circuit, and the differential amplifier circuit is supplied with the power source voltage, comparing the control voltage and the reference voltage and carrying out differential the differential amplification by the power source voltage.

6. The voltage generating circuit according to claim 4, further comprising a reference voltage switching circuit for carrying out a switching operation between the power source voltage and the ground voltage in accordance with a reference voltage switching signal, wherein the second input is connected to the output of the reference voltage switching circuit.

7. The voltage generating circuit according to claim 4, further comprising:

a second reference voltage generating circuit, being different from the reference voltage generating circuit, for generating a reference voltage on the basis of the power source voltage, and a reference voltage switching circuit for carrying out a switching operation between the power source voltage or the ground voltage and the reference voltage in accordance with a reference voltage switching signal, wherein the second input is connected to the output of the reference voltage switching circuit.

8. The voltage generating circuit according to claim 4, further comprising:

a second reference voltage generating circuit, being different from the reference voltage generating circuit, for generating a reference voltage from the power source voltage, and a reference voltage switching circuit for selecting any one of the power source voltage, the ground voltage and the reference voltage in accordance with a reference voltage switching signal, wherein the second input is connected to the output of the reference voltage switching circuit.

9. The voltage generating circuit according to claim 4, further comprising:

an external voltage applying circuit for carrying out a switching operation between an external voltage and either the power source voltage or the ground voltage in accordance with an external voltage applying signal and outputting the switched one, wherein the second input is connected to the output of the external voltage applying circuit.

10. The voltage generating circuit according to claim 4, further comprising:

a second reference voltage generating circuit, being different from the reference voltage generating circuit, for generating a reference voltage from the power source voltage, and an external voltage applying circuit for carrying out a switching operation between an external applied voltage and the reference voltage in accordance with an external voltage applying signal and outputting the switched one, wherein the second input is connected to the output of the external voltage applying circuit.

11. The voltage generating circuit according to claim 6, further comprising:

an external voltage applying circuit for receiving an external applied voltage and the output voltage of the reference voltage switching circuit, and switching and outputting the output voltage in accordance with an external voltage applying signal, wherein the second input is connected to the output of the external voltage applying circuit.

12. The voltage generating circuit according to claim 1, wherein the voltage variation detecting circuit comprises:

a current mirror circuit having a first intermediate node connected between the first input and the second input, and the first output connected between the first input and the third input, reference current equivalent to current occurring due to the potential difference between the first input and the second input being made to flow from the first input to the first output by detecting the voltage at the first intermediate node;

resistance means connected between the first intermediate node and the second input; and a control voltage generating circuit that is connected between the first output and the third input, and generates the control voltage at the first output by making the reference current flow therethrough.

13. The voltage generating circuit according to claim 3, wherein the voltage variation detecting circuit comprises:

a current mirror circuit having a first intermediate node connected between the first input and the second input, and the first output connected between the first input and the third input, reference current that is kept to have a fixed current ratio to current occurring due to the potential difference between the first input and the second input being made to flow from the first input to the first output by the voltage applied to the fourth input;

resistance means connected between the first intermediate node and the second input; and a control voltage generating circuit that is connected between the first output and the third input and generates the control voltage at the first output by making the reference current flow therethrough.

14. The voltage generating circuit according to claim 12, wherein the resistance means has plural resistors that are connected to one another in series between the first intermediate node and the second input.

15. The voltage generating circuit according to claim 12, wherein the resistance means has plural first conduction type tenth transistors that are connected to one another in series between the first intermediate node and the second input so that a gate and a drain are connected to each other and a substrate and a source are connected to each other.

16. The voltage generating circuit according to claim 12, wherein the control voltage generating circuit has plural resistors that are connected to one another in series between the first output and the third input.

17. The voltage generating circuit according to claim 12, wherein the control voltage generating circuit has one or more first conduction type tenth transistors that are connected to one another in series between the first output and the third input so that a gate and a drain are connected to each other and a source and a substrate are connected to each other.

18. The voltage generating circuit according to claim 12, wherein the current mirror circuit comprises:

a first conduction type eleventh transistor having a source connected to the first input, and a gate and a drain connected to the first intermediate node; and a first conduction type twelfth transistor having a source connected to the first input, a gate connected to the first intermediate node and a drain connected to the first output.

19. The voltage generating circuit according to claim 12, wherein the current mirror comprises:

plural resistors connected to one another in series between the first input and the first intermediate node; and a first conduction type thirteenth transistor having a source connected to the first input, a gate connected to the first intermediate node and a drain connected to the first output.

20. The voltage generating circuit according to claim 12, wherein the current mirror circuit comprises:

a first conduction type eleventh transistor having a source connected to the first input, and a gate and a drain that are connected to the first intermediate node;

a first conduction type twelfth transistor having a source connected to the first input, a gate connected to the first intermediate node and a drain connected to the second intermediate node; and a first conduction type thirteenth transistor having a source connected to the second intermediate node, a gate connected to any terminal of the resistance means, and a drain connected to the first output.

21. The voltage generating circuit according to claim 12, wherein the current mirror circuit comprises:

plural resistors that are connected to one another in series between the first input and the first intermediate node;

a first conduction type twelfth transistor having a source connected to the first input, a gate connected to the intermediate node and a drain connected to the second intermediate node; and a first conduction type thirteenth transistor having a source connected to the second intermediate node, a gate connected to any terminal of the resistance means and a drain connected to the first output.

22. The voltage generating circuit according to claim 13, wherein the current mirror circuit comprises:

a first conduction type eleventh transistor having a source connected to the first input, and a gate and a drain that are connected to the first intermediate node;

a first conduction type twelfth transistor having a source connected to the first input, a gate connected to the first intermediate node and a drain connected to the second intermediate node; and a first conduction type thirteenth transistor having a source connected to the second intermediate node, a gate connected to the fourth input and a drain connected to the first output.

23. The voltage generating circuit according to claim 13, wherein the current mirror circuit comprises:

plural resistors connected to one another in series between the first input and the first intermediate node;

a first conduction type twelfth transistor having a source connected to the first input, a gate connected to the first intermediate node and a drain connected to the second intermediate node; and a first conduction type thirteenth transistor having a source connected to the second intermediate node, a gate connected to the fourth input and a drain connected to the first output.

24. A voltage generating circuit having a negatively boosting circuit for generating a voltage lower than the ground voltage by using a power source voltage, and a reference voltage generating circuit for generating a reference voltage, a desired voltage being generated on the basis of the reference voltage, comprising:

a voltage variation detecting circuit having a first input connected to the power source, a second input connected to the output of the negatively boosting circuit, and a third input connected to the ground, reference current equivalent to current occurring due to the potential difference between the first input and the second input being made to flow into the third input to generate a control voltage at a first output;

a differential amplifier circuit for comparing the control voltage and the reference voltage; and a clamp circuit for outputting the desired voltage by extracting current from the output of the negatively boosting circuit in accordance with the output of the differential amplifier circuit to control the output voltage of the negatively boosting circuit.

25. The voltage generating circuit according to claim 24, wherein the clamp circuit comprises a second conduction type transistor having a source and a substrate that are connected to the output of the negatively boosting circuit, a gate connected to the output of the differential amplifier circuit and a drain connected to the power source or the ground, and the differential amplifier circuit is supplied with the power source voltage and the output voltage of the negatively boosting circuit, compares the control voltage and the reference voltage with each other and carries out differential amplification on the basis of the power source voltage and the output voltage of the negatively boosting circuit.

26. The voltage generating circuit according to claim 24, wherein said clamp circuit comprises:

a second conduction type first transistor having a source and a substrate that are connected to the output of the negatively boosting circuit, and a gate and a drain that are connected to a first terminal;

a second conduction type second transistor having a source and a substrate that are connected to the output of the negatively boosting circuit; and a first conduction type transistor connected between the power source and the first terminal and having a gate connected to the output of the differential amplifier circuit, and said differential amplifier circuit is supplied with the power source voltage and the ground voltage, compares the control voltage and the reference voltage with each other and carries out differential amplification on the basis of the power source voltage and the ground voltage.

27. The voltage generating circuit according to claim 24, further comprising:

first switching means for receiving a set voltage switching signal and carrying to a switching operation between the power source voltage and the voltage of the second input and outputting the switched one; and second switching means connected between two terminals between the first input and the second input, and switching the potential difference between the first input and the second input in accordance with the output of the first switching means.

28. The voltage generating circuit according to claim 24, further comprising:

a reference voltage switching circuit for any two voltages or three voltages of the power source voltage, the reference voltage and any reference voltage generated by the power source voltage on the basis of a reference voltage switching signal;

wherein the first input is connected to the output of the reference voltage switching circuit.

29. The voltage generating circuit according to claim 24, further comprising:

an external voltage applying circuit having means for carrying out a switching operation between an external applied voltage and the power source voltage, the reference voltage or any reference voltage generated by the power source voltage, wherein the first input is connected to the output of the external voltage applying circuit.

30. The voltage generating circuit according to claim 28, further comprising:

an external voltage applying circuit for receiving an external applied voltage and the output voltage of the reference voltage switching circuit, carrying out a switching operation between the external applied voltage and the output voltage of the reference voltage switching circuit in accordance with an external voltage applying signal and outputting the switched one, wherein the first input is connected to the output of the external voltage applying circuit.

31. The voltage generating circuit according to claim 1, wherein a voltage having the same voltage level as the reference voltage can be applied by a voltage follower circuit.

32. A voltage generating circuit having a negatively boosting circuit for generating a voltage lower than the ground voltage by using a power source voltage, and a reference voltage generating circuit for generating a reference voltage, a desired voltage being generated on the basis of the reference voltage, comprising:

a level shift circuit for receiving an output voltage of the negatively boosting circuit, and outputting the desired voltage thus level-shifted;

a voltage variation detecting circuit having a first input connected to the power source, a second input connected to the output of the level shift circuit, and a third input connected to the ground, reference current equivalent to current occurring due to the potential difference between the first input and the second input being made to flow into the third input to generate a control voltage at a first output; and a differential amplifier circuit for comparing the control voltage and the reference voltage to control the level shift circuit, and outputting a said desired negative voltage at the output of the level shift circuit.

33. The voltage generating circuit according to claim 32, wherein the level shift circuit has a second conduction type transistor having a source and a substrate that are connected to the output of the negatively boosting circuit, a gate connected to the output of the differential amplifier circuit and a drain connected to the output of the level shift circuit, and the differential amplifier circuit is supplied with the power source voltage and the output voltage of the negatively boosting circuit, compares the control voltage and the reference voltage and carries out differential amplification on the basis of the power source voltage and the output voltage of the negatively boosting circuit.

34. The voltage generating circuit according to claim 32, wherein the level shift circuit comprises a second conduction type first transistor having a source and a substrate that are connected to the output of the negatively boosting circuit, and a gate and a drain that are connected to a first terminal, a second conduction type second transistor having a source and a substrate that are connected to the output of the negatively boosting circuit, a gate connected to the first terminal and a drain connected to the output of the level shift circuit, and a first conduction type transistor that is connected between the power source and the first terminal and has a gate connected to the output of the differential amplifier circuit, wherein the differential amplifier circuit is supplied with the power source voltage and the ground voltage, compares the control voltage and reference voltage and carries out differential amplification on the basis of the power source voltage and the ground voltage.

35. A voltage generating circuit comprising:

a reference voltage generating circuit for generating a reference voltage and a voltage generating circuit for generating a desired voltage on the basis of the reference voltage, comprising:

a level shift circuit for receiving a ground voltage and outputting a desired voltage thus level-shifted;

a voltage variation detecting circuit having a first input connected to the power source, a second input connected to the output of the negatively boosting circuit, and a third input connected to the ground, reference current equivalent to current occurring due to the potential difference between the first input and the second input being made to flow into the third input to generate a control voltage at a first output; and a differential amplifier circuit having means for comparing the control voltage and the reference voltage to control the level shift circuit so that a voltage dropped from said desired power source voltage is output from the output of the level shift circuit is output.

* * * * *